US007357537B2

(12) United States Patent
Masuoka et al.

(10) Patent No.: US 7,357,537 B2
(45) Date of Patent: Apr. 15, 2008

(54) LIGHT SOURCE FOR PROJECTOR AND PROJECTION TYPE IMAGE DISPLAY APPARATUS USING THEREOF

(75) Inventors: Nobuo Masuoka, Chigasaki (JP); Koji Hirata, Yokohama (JP); Yoshie Kodera, Chigasaki (JP); Ryuji Kurihara, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 314 days.

(21) Appl. No.: 10/994,752

(22) Filed: Feb. 4, 2005

(65) Prior Publication Data

US 2006/0007410 A1 Jan. 12, 2006

Related U.S. Application Data

(62) Division of application No. 10/199,406, filed on Jul. 19, 2002, now Pat. No. 6,863,418.

(30) Foreign Application Priority Data

Nov. 6, 2001 (JP) ..... 2001-340129
Apr. 2, 2002 (JP) ..... 2002-99521

(51) Int. Cl.
*F21V 7/00* (2006.01)

(52) U.S. Cl. ..... 362/346; 362/264; 362/293; 353/98

(58) Field of Classification Search ..... 362/263, 362/264, 293, 346, 518, 304; 353/98, 99; 313/113; 359/869, 884
See application file for complete search history.

(56) References Cited

U.S. PATENT DOCUMENTS 3,818,210 A * 6/1974 Pitkjaan ..... 362/518
4,555,748 A 11/1985 Bradley
4,774,636 A * 9/1988 Gaugel et al. ..... 362/263
5,947,590 A 9/1999 Meuse et al.
5,985,465 A 11/1999 Daichou et al.
6,509,674 B1 1/2003 Nakagawa

FOREIGN PATENT DOCUMENTS

JP 46-54411 U 6/1971

(Continued)

*Primary Examiner*—Stephen F. Husar
(74) *Attorney, Agent, or Firm*—Townsend and Townsend and Crew LLP

(57) ABSTRACT

Provided is a projector light source which can effectively project a light beam having a sufficient volume from a lamp as a light source, and which is highly accurate and is excellent in workability. The projector light source comprising an arc tube for emitting a light beam; and a concave reflector including a hold part for holding the arc tube, and having a concave reflection surface for reflecting the light beam from the arc tube so that the light beam outgoes through an opening of the reflector, the concave reflector comprising a first reflector located in the vicinity of the hold part for holding the light emitting tube, and second reflector located in a part other than the hold part, and made of a material different from that of the first reflector. Further, the first reflector is made of heat-resistant glass, and the second reflector is made a material containing a heat-resistant organic material having a thermal deformation temperature which is lower than that of the heat-resistant glass.

15 Claims, 26 Drawing Sheets

FOREIGN PATENT DOCUMENTS

| | | | |
|---|---|---|---|
| JP | 03-203109 | A | 9/1991 |
| JP | 05-182502 | A | 7/1993 |
| JP | 05-325611 | A | 12/1993 |
| JP | 06-052706 | A | 2/1994 |
| JP | 2001-135130 | A | 5/2001 |
| JP | 2001-155527 | A | 6/2001 |
| JP | 2001-290218 | A | 10/2001 |

* cited by examiner

LIGHT SOURCE FOR PROJECTOR AND PROJECTION TYPE IMAGE DISPLAY APPARATUS USING THEREOF

BACKGROUND OF THE INVENTION

The present invention relates to an improvement in a reflector used in a light source for a projector such as a liquid crystal projector or an overhead projector.

Heretofore, a light source composed of an arc tube and a reflector for reflecting and emitting light from the arc tube, has been used as a light source for a projector such as a liquid crystal projector or an overhead projection. As the arc tube, there has been in general used a short arc type metal halide lamp in which metal halide is charged in an arc tube in order to use light emission inherent to the metal, and which has a short distance between electrodes distance. Further, as the reflector, there has been used a reflector in which the inner wall surface of a heat-resistant glass material is coated thereover with a multilayer film made of titanium oxide or silicon dioxide. These days, instead of the metal halide lamp, there have been prosperously used an extra high pressure mercury lamp which can easily exhibit a high intensity and a Xenon lamp which can exhibit a high glossy color property. Of these lamp, the extra high pressure mercury lamp has been improved in its light emitting efficiency by increasing the vapor pressure of mercury in the lamp up to a value higher than 120 atm during turn-on thereof so as to materialize the high bright intensity. Further, in addition to the mercury, an additive is mingled so as to improve a spectral distribution characteristic, thereby the glossy color property can be enhanced.

However, since the above-mentioned mercury lamp has an optimum operating temperature range which is narrow, there have been caused such problems that its luminous efficiency becomes lower or the use life of a lamp bulb thereof becomes shorter if it is used out of a desired optimum range.

A reflector used in the light source for a projector, is formed in a method comprising the steps of press-forming heat-resistant glass having a low thermal expansion rate, thereafter, coating the reflector over its inner surface with an aluminum vapor deposited film having a reflectance rate of 90%, and further, subjecting the aluminum vapor deposited film to an antioxidation process over its outer surface These years, there has been increased such a market demand that the intensity of the lamp has to becomes higher, and accordingly, an optical multilayer film made of $TiO_2$ of $SiO_2$ has been prosperously used in order to obtain a reflectance rate higher than that of the aluminum vapor deposited film as the reflecting film on the inner surface of the reflector. A light beam projected from the reflector becomes in general a parallel light ray beam or a converged light ray beam. Accordingly, the shape of the reflecting surface of the reflector is in general parabolic or elliptic.

Referring to FIG. 1 which is a sectional view illustrating a light source for a projector used in general and using an extra-high pressure mercury lamp, an arc tube made of quartz glass, having a power consumption of 100 W class, and having an internal volume of 55 μl is enclosed therein with electrodes at its opposite ends with an arc length which is set in a range of about 1 to 4 mm. The arc tube 1 is charged therein with mercury as a luminescent substance, and argon as a start aid gas added with hydrogen bromide at a normal volume rate with respect to argon. An electrode wire rod 3 is welded thereto with molybdenum foils 4 so that, and lead wire electrode sealing parts 5 are formed. The electrode sealing part 5 on the reflector opening side is connected thereto with a lead wire fitting 19 as a power source terminal through the intermediary of a lead wire 18. A base 6 serving as another power source terminal is attached to the electrode sealing part 5 on the reflector bottom side. The base 6 is bonded and fixed to the bottom part of the reflector 7 formed over its inner surface with a multilayer reflection film for reflecting visual light and transmitting therethrough infrared rays, by means of cement 8. At this stage, the arc tube 1 is fixed so that the arc axis of the arc tube is located substantially at the focal point of the reflector. With the use of a flange part of the reflector at the front opening, a front face glass pane 9 having a thermal expansion rate the same as that of the reflector 7 is fitted. This front face glass pane 9 is adapted to prevent fragments of the arc tube from scattering when the arc tube bursts, and is applied at opposite surfaces thereof with anti-reflection coating.

FIG. 2 shows a use configuration in which an illumination optical system including the light source for a projector as shown in FIG. 1 is used as a light source for an optical instrument such as a liquid crystal projector, an overhead projector or the like. A cooling fan 10 is installed at a side or rear surface of the projector. Further, air from the cooling fan 10 is blown onto the reflector 7 so as to obtain a desired cooling effect. Alternatively, air around the light source which is heated by the light source which has been turned on is drawn out so as to create air stream in order to cool the reflector 7.

There has been used an image display element or a DMD (digital micro mirror device) such as a liquid crystal display panel, in which pixels are arranged in a matrix-like pattern, as measures for modulating the intensity of illumination light which has been uniformly distributed by the illumination optical system using the light source for a projector. TV signals or image signals from a computer are inputted to this image display element in order to display images on the screen thereof. The light from the light source is modulated by the image on the image display element. The modulated light is then magnified and projected through the intermediary of a projection lens. The so-called projection type image projector includes a separate screen on to which the magnified light is projected thereby. Meanwhile, the so-called rear-projection type image display apparatus includes a screen onto which the magnified image is projected on the rear side of the screen so as to display the image thereon. These image display apparatuses have been widely diffused at the market.

SUMMARY OF THE INVENTION

The reflector used in a prior art light source for a projector, as mentioned above, has been produced by press-forming a heat resistant glass pane into a desired shape. This heat resistant glass pane is poor in fluidity, and the control of the material temperature and the weight thereof have been difficult in the case of the press-forming of the heat-resistant glass pane. Further, hot water or oil having a high specific heat cannot be used for adjusting the temperature of dies thereof. Thus, the morphological stability thereof is poor in comparison with that of thermoplastic or thermosetting plastic materials which are in general used.

FIG. 12 is a structural view illustrating a bi-split type reflector in which a reflector 7*j* whose a reflection surface has an elliptic cross-sectional shape and a reflector 7*k* (having a diameter of 116 mm with a reflection surface diameter of 54 mm and a depth of 100 mm) whose reflection surface has a circular cross-sectional shape are joined to each other, and the base 6 of the arc tubes tube 1 as a light source is bonded to the reflector 7*j*. In FIG. 12, like reference numerals are used to denote like parts to those shown in FIG. 1, and accordingly, detailed explanation thereof will be omitted.

In order to check the form accuracy of the reflector, the reflector 7*k* as shown in FIG. 12 was trially manufactured by press-forming the heat-resistant glass pane. The forming accuracy (errors from a design morphology) exceeds 700 μm, and a substantially vertical surface was obtained at the opening of the reflector due to contraction of the formed article even though dies having a draft angle of 3 degrees were used, and accordingly, the die-release ability was worth. As a result, the formed article was deformed into a saddle-like shape by 1,300 μm, that is, a satisfactory shape could not be obtained.

Thus, a reflector press-formed and having a relatively large bore diameter exceeding 90 mm causes problems in the formability (transcription or reproducibility), and accordingly, it has to have a monotonous inner surface configuration such as an elliptic or a parabolic shape. Specifically, the prior art reflector made of heat-resistant glass has caused such a first problem. that an inner surface configuration resembling to a design configuration cannot be stably obtained with a high degree of accuracy.

Further, since the prior art reflector made of heat-resistant glass is formed by pressing, an extracting direction in which an article is extracted is limited only to either of two vertical directions. Accordingly, there is caused such a second problem that a complicated configuration cannot be formed, that is, for example, concavities and convexities cannot be formed in the exterior surface of the reflector.

The present invention has been devised in view of the above-mentioned problems inherent to the above-mentioned prior art, and accordingly, an object of the present invention is to provide a light source for a projector incorporating a reflector which is accurate and is excellent in formability, workability and as well is excellent in heat-resistance and reflectance, and a projector incorporating thereof.

Specifically, according to the present invention stated in claim 1, there is provided a configuration having following features: a reflector is composed of a first reflector and a second reflector which is separated from each other by a plane orthogonal to the optical axis of the reflector, the first reflector including a hold part for holding an arc tube while the second reflector includes an opening from which light is emitted, and further, the first reflector being made of a first material such as heat-resistant glass while the second reflector is made of a second material whose thermal deformation temperature is lower than that of the first material.

Further, the reflector part made of a heat-resistant organic material can transmit a heat generated from the arc tube when the later is turned on, to heat radiation fins such as protrusions formed at the external surface of the reflector as stated in claim 3 or 4, through the intermediary of a high thermal conductive substance mingled in the reflector. Thus, the heat can be efficiently transmitted to the exteriority, thereby it is possible to enhance the cooling efficiency. If the heat radiation fins are attached in parallel with the direction of the flow of air brown from a cooling fan, the heat-radiation can be made with an extremely high degree of accuracy.

Further, as stated in claim 7, the reflector is split into at least two at a plane which is parallel to the optical axis of the reflector (in particular, the second reflector) and which contains the optical axis, and accordingly, the reflection surface thereof can have such a configuration that the degree of freedom of design therefor is large.

Specifically, as to a heat-resistant organic material usable for the reflector, there may be used thermosetting resin which will be referred to as BMC (bulk molding compounds) and which is obtained by adding a thermoplastic polymer, a hardener, a filler glass fibers and an organic filler, and as well alumina hydroxide capable of enhancing the thermal conductivity, as stated in claim 7, into low constrictive unsaturated polyester resin, and a molded article obtained by molding the BMC enables the temperature weight control thereof and the temperature control of the dies and the material with a high degree of accuracy. Further, it is excellent in moldability.

Accordingly, as shown in FIG. 9, even through the configuration of the inner surface of the reflector is complicated so as to include a high order coefficient of an aspheric formula, in comparison with a conventional elliptic or parabolic surface formula, a reflection surface with a high degree of accuracy can be obtained. The reflector is molded from a heat resistant organic material in which a high thermal conductive substance is mingled, thereby it is possible to obtain a reflector with a high degree of accuracy.

Further, a reflection film formed on the reflection surface of the reflector has a characteristic with which light rays in an ultraviolet range, not greater than 410 nm, can transmit therethrough. With this arrangement, by adding an ultraviolet absorber in the above-mentioned thermosetting resin, it is possible to prevent detrimental ultraviolet rays from leaking to the outside from the reflector. Light rays in a near infrared range, not less than 800 nm is also allowed to transmit through the reflection film in view of the characteristic of the reflection film. As a result, heat flux (including near infrared rays and infrared rays) can be absorbed, thereby it is possible to restrain the temperature of components included in the projector form rising, thereby the use lives thereof can be enhanced. Simultaneously, if the transmittance of light rays in a range from 420 to 700 nm within a visible ray range can be restrained to a value not greater than 15%, thereby it is possible to obtain a reflector with a high degree of efficiency.

Further, protrusions are formed either of the first reflector and the second reflector, while holes pairing with the protrusions are formed in the other one of them, and the protrusions and the holes in pairs are dowelled with one another so as to align and fix the first reflector with the second reflector with a gap formed between the first reflector and the second reflector. With this arrangement, the surface area of contact between the first reflector and the second reflector can be reduced, thereby it is possible to reduce the heat conductivity from the first reflector which holds the arc tube, to the second reflector. Thus, the material, for example, heat-resistant resin from which the second reflector is made, may have a large margin for an allowable temperature range thereof. With this arrangement it is desirable to set the gap between the first reflector and the second reflector to a value from 0.1 mm to 2 mm in such a condition that the protrusions and the holes are dowelled to one another, and to set the number of the pairs of the protrusions and the holes to at least three. With this arrangement, an air layer in the gap can restrain heat transmission from the first reflector to the second reflector, and convention heat in the light source can be radiated through this gap.

Further, synthetic resin bristles having a diameter of 30 to 50 μm and a length of 0.1 to 0.3 mm are planted to the external wall surface of the second reflector so as to increase the surface area of the external wall surface thereof in order to enhance the heat radiation, so as to exhibit such an effect that a risk of heat injury can be reduced even though a human hand makes contact with the external wall of the reflector due to the provision of the air layer by the bristles.

Further, in the dies for the BMC, die components including a side core or a vertical slide core can be slid in several directions, and accordingly, the moldability thereof can be enhanced even though the reflector has a complicated external configuration.

With the use of the above-mentioned light source for a projector in a projection type image projector or a rear-projection type image display apparatus, the light conversion efficiency of a lamp can be enhanced, thereby it is possible to obtain a bright and satisfactory image.

Explanation will be hereinbelow made of preferred embodiments of the present invention with reference to the accompanying drawings in which:

Other objects, features and advantages of the invention will become apparent from the following description of the embodiments of the invention taken in conjunction with the accompanying drawings.

DETAILED DESCRIPTION OF PREFERRED EMBODIMENTS

Figure 1:
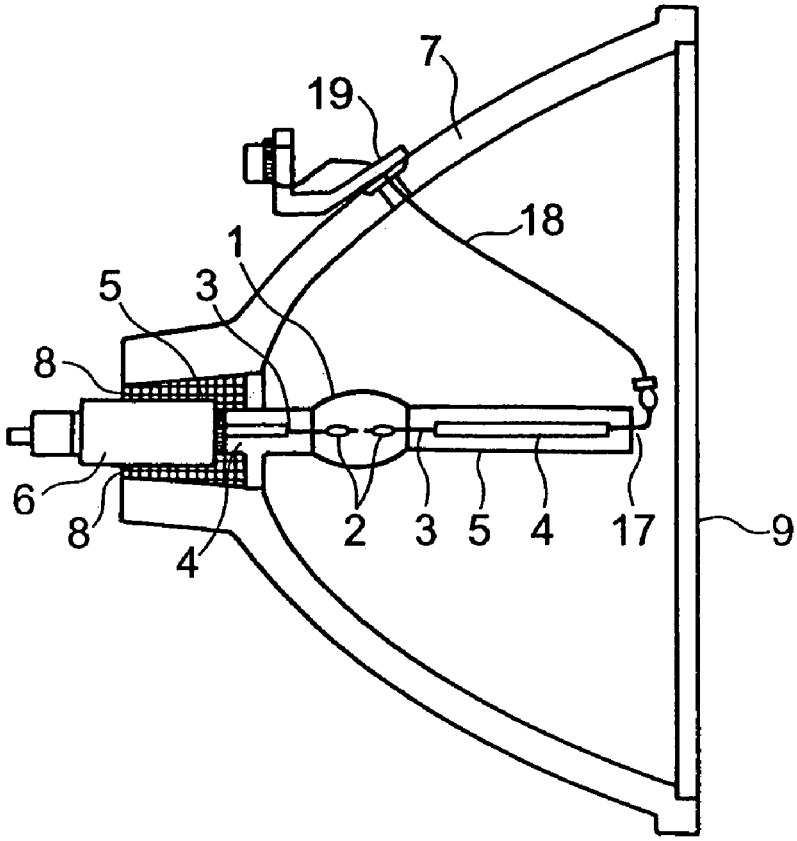
FIG. 1 is a sectional view illustrating a light source for a projector used in general, using an extra-high pressure mercury lamp as a light source.
Figure 2:
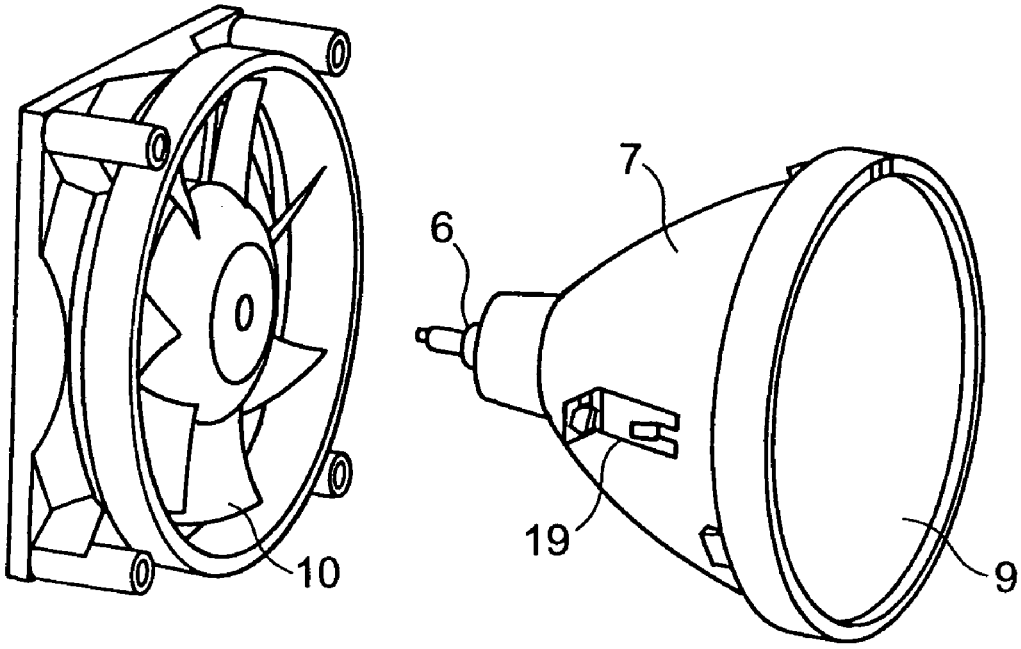
FIG. 2 is a view illustrating a layout of a use configuration of a light source for an optical instrument such as a liquid crystal projector.

It is noted the applicants has been filed Japanese Patent Application No. 2001-114763 relating to a configuration which can solve the problems of the present invention as mentioned above. The present application proposes such a configuration that a heat-resistant organic material is used as a base material for a reflector, instead of heat-resistant glass, which can extremely enhance the molding accuracy with respect to a design configuration while heat-resistance is ensured.

Explanation will be hereinbelow made of a specific form of the configuration. In order to check the accuracy of the configuration of a reflector used in a light source for a projector, a spherical reflector (a diameter of 116 mm (reflection surface radius of 54 mm) and a depth of 100 mm) as indicated by reference numeral 7*k* shown in FIG. 12, was trially manufactured from a RIGOLAC BMC (RNC-428) produced by Showa Highpolymer Co., Ltd, which is a heat-resistant organic material. As a result, a deviation from a design configuration was 10 μm at maximum, and by setting the accurate temperature adjustment and the weight control of dies to values not greater than 0.5%, unevenness among lots could be restrained from exceeding 3 μm.

Further, since the BMC is excellent in die releasability even though a molded surface is substantially vertical, excellent transcription ability is exhibited so that substantially no die release angle which is required for extracting a mold product from dies) is required and so forth. The configuration of the reflection surface of the reflector which is resembled to its design configuration can be stably obtained with a high degree of accuracy. It is noted that the above-mentioned BMC is the abbreviation of bulk molding compounds.

In the dies for BMC, die components including a side core and a vertical slide core can be slid in several directions, satisfactory moldability can be obtained even though the external configuration is complicated. Thus, heat radiation fins are provided to the external wall of the reflector so as to exhibit such an advantage that the heat resistance thereof can be enhanced due to the provision of the heat radiation fins.

In addition to the check for the accuracy of the configuration as mentioned above, Al (aluminum) was vapor-deposited on the inner surface of the reflector so as to form a reflection surface while a 200 W extra-pressure mercury lamp was fixed to the reflector having a focal distance of 30 mm. The lamp was then turned on. In this condition, temperatures of the reflection surface and the external wall surface of the reflector were measured. As a result, the temperature of the reflection surface was 132 deg.C. while the temperature of the outer wall thereof was 83 deg.C. at a room temperature of 20 deg.C. with no wind. Thus, a satisfactory trial manufacture result was obtained so as to have a margin near 70 deg.C. with respect to the thermal deformation temperature of the material, which was 200 deg.C.

However, in view of a distance between an arc tube and the inner wall surface of the reflector, it was pointed out that if the focal distance is not greater than 40 mm, no margin as to the heat-resistant temperature thereof was present, and if the input power exceeds 250 deg, no margin was present with respect to the heat-resistant temperature. Thus, there was caused a problem in the heat resistance.

Figure 3:
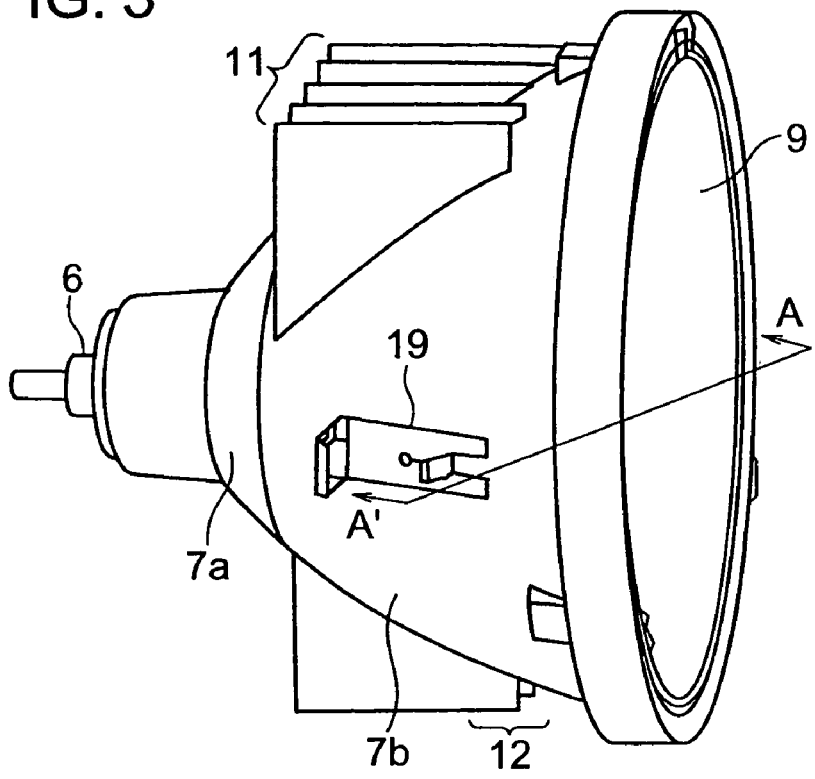
FIG. 3 is a perspective view illustrating an embodiment of a light source for a projector according to the present invention.
Figure 4:
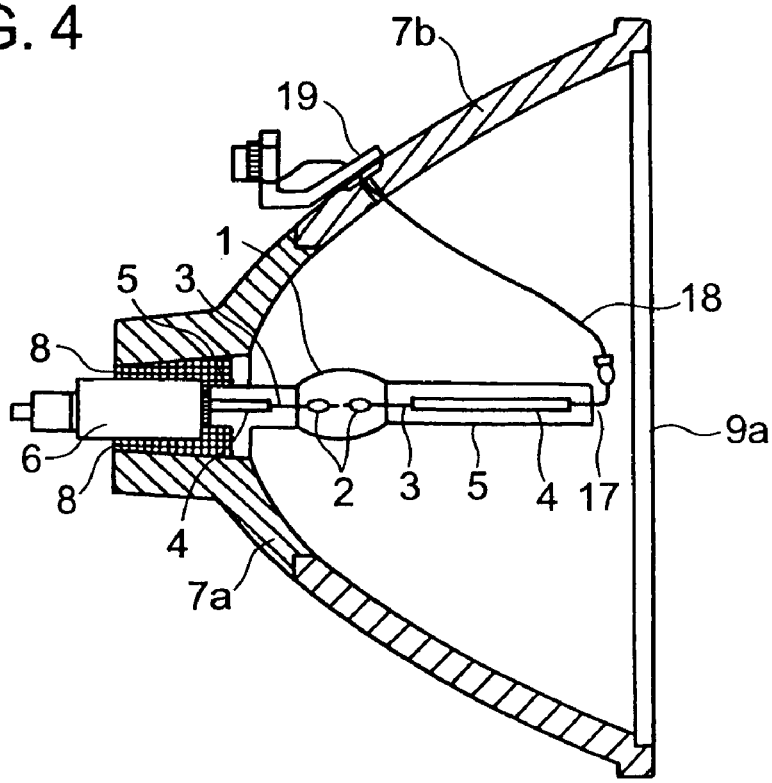
FIG. 4 is a sectional view illustrating an embodiment of the light source according to the present invention.

Explanation will be hereinbelow made of a first embodiment of the present invention which can solve the above-mentioned problem, with reference to FIGS. 3 and 4. Referring to FIG. 3 which shows a reflector in the first embodiment of the present invention, the reflector is composed of at least two portions (a first reflector and a second reflector) which are made of at least two kinds of materials having different thermal deformation temperatures. The essential feature of the reflector in this embodiment, is the provision of two portions separated from each other at a plane orthogonal to the optical axis of the reflector, and the two different materials are used respectively on both sides of the split plane as a boundary. FIG. 4 is a sectional view illustrating the reflector in the first embodiment of the present invention shown in FIG. 3 along A-A' line. In FIGS. 3 and 4, like reference numerals are used to denote like parts to those shown in FIG. 1 in order to omit detailed description thereof.

Since the temperature of the reflector becomes high in a portion (including a holding part for holding the arc tube 1 and a part therearound) in the vicinity of a light bulb of the arc tube 1 serving as a heat source is high, the first reflector 7*a* having a small bore diameter and made of heat-resistant glass having a high thermal deformation temperature (about 500 to 600 deg.C.) is used in this portion. As has been well-known, even with a reflector made of heat-resistant glass and having a diameter of not greater than 60 mm, the accuracy of configuration about 50 μm can be materialized. In this phase, the linear expansion rate of the heat resistance glass to be used is desirably not greater than $50\times10^{-5}$ ($1/K^{-1}$) in view of burst caused by linear expansion.

Further, since the temperature of the second reflector 7*b* which is remote from the light bulb of the arc tube 1 in the direction of light projection is low, the second reflector 7*b* is desirably molded from a material in which a thermoplastic polymer as a low constrictive agent, a hardener, a filler, glass fibers, an inorganic filler and the like are added in low constrictive unsaturated polyester resin which is a heat-resistant material so as to enhance the heat-resistance (thermal expansion temperature of about 200 to 250 deg.C.), such as This material may be, for example, Rigolac BMC (RNC-428) produced by Showa Polymer Co., Ltd. Thus, a reflector having a high degree of molding accuracy can be obtained. Since the RNC-841 utilizes calcium carbonate as a filler, the thermal conductivity thereof is 0.5 W/m·k deg. so as to obtain a satisfactory characteristic. As to a material which aims at further enhancing the thermal conductivity, RNC-841 containing alumina hydroxide as a filler and produced by the same company has a thermal conductivity of 0.8 W/m·K deg. which is about 1.6 times as high as that of RNC-428.

As mentioned above, the reflector is made of at least two kinds of materials having different thermal-deformation temperatures, and the portion (the first reflector 7*a*) including a part for holding the arc tube and a part therearound is made of a material having a heat-resistant temperature while the portion (the second reflector 7*b*) including an opening for projecting light is made of a material having high moldability. Thus, the above-mentioned problem can be solved. It is noted that the first reflector 7*a* and the second reflector 7*b* are fixed to each other by a fixing method which is not shown. The detailed fixing structure and method will be explained later.

Referring to FIG. 3, the external wall surface of the second reflector 7*b* made of the heat-resistant material, is formed thereon with heat radiation fins 11, 12 on the upper and lower parts thereof. The heat-resistant organic material can exhibit satisfactory moldability, even with a complicated external configuration, as mentioned above, and accordingly, the heat radiation fins can be provided in order to obtain an excellent heat radiation capability.

Figure 5:
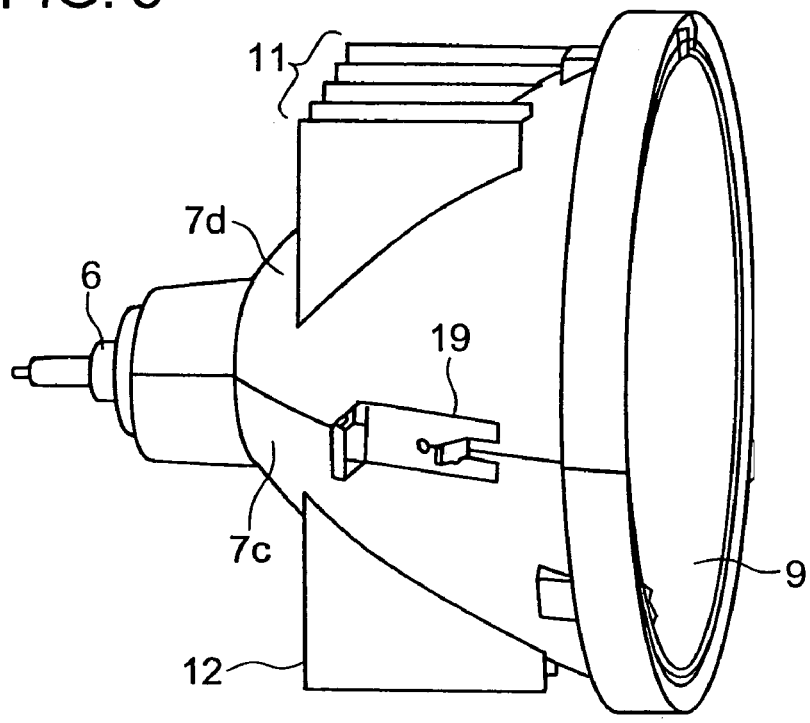
FIG. 5 is a perspective view illustrating an embodiment of the light source for a projector according to the present invention.
Figure 6:
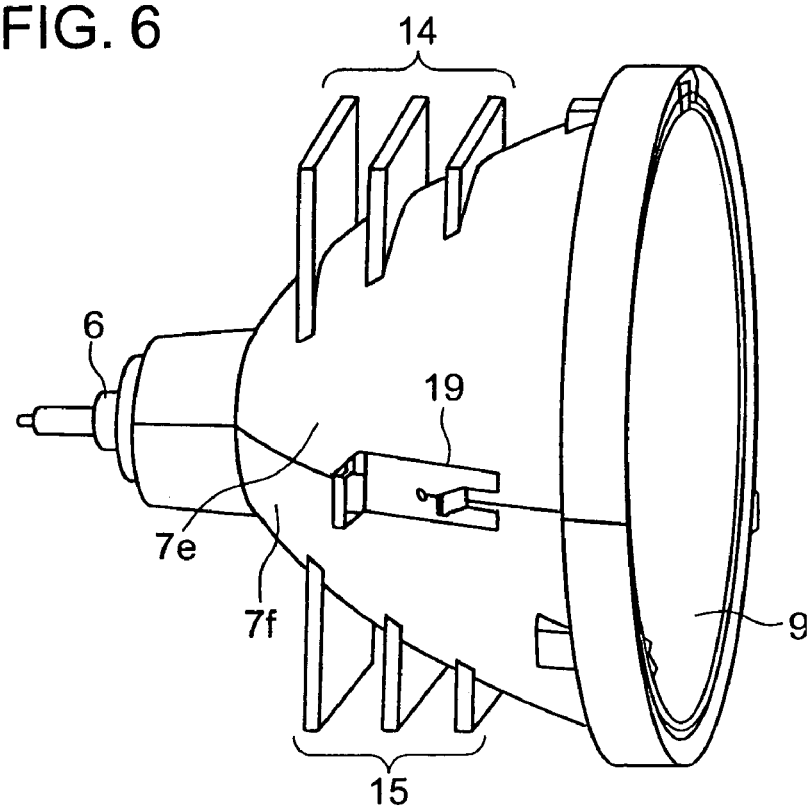
FIG. 6 is a perspective view illustrating an embodiment of the light source for a projector according to the present invention.
Figure 7:
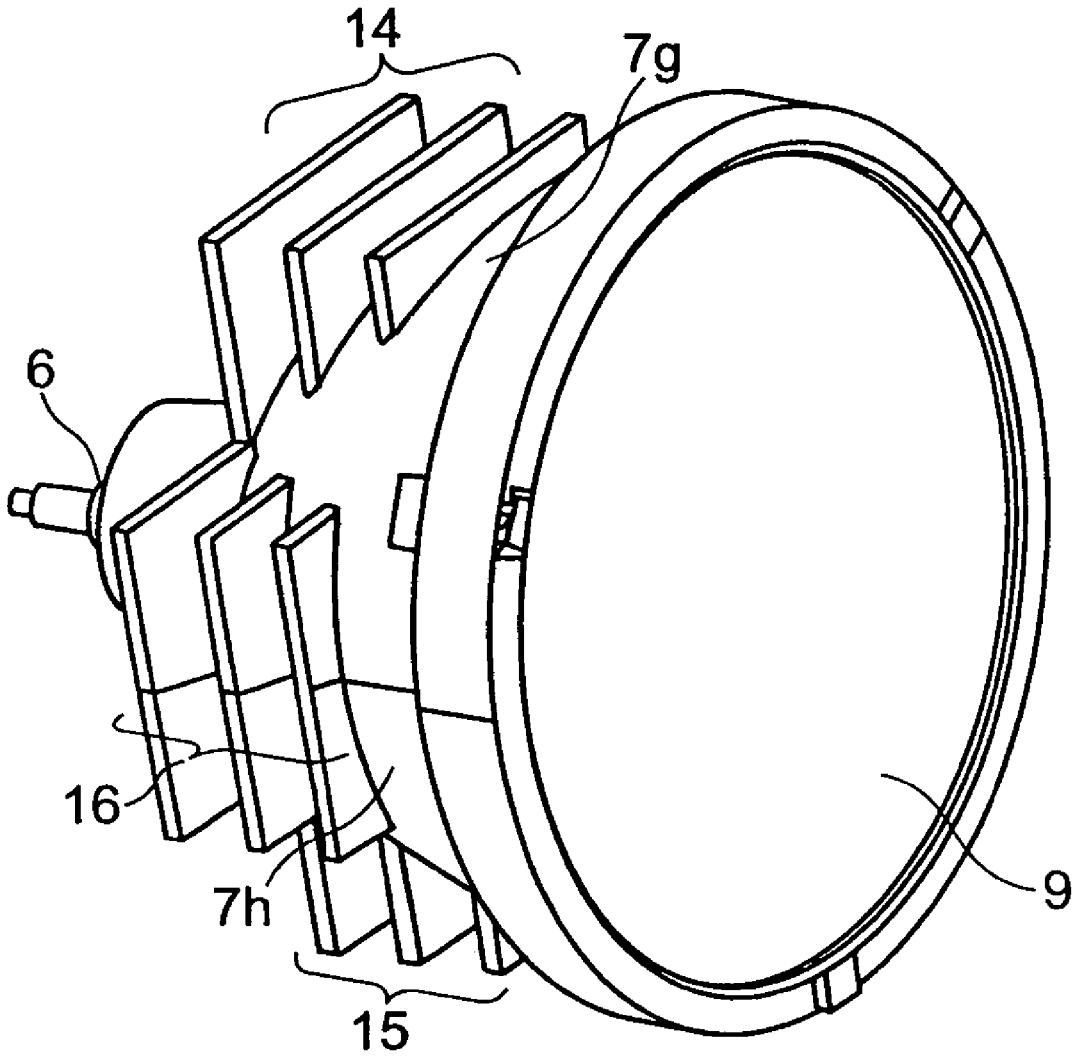
FIG. 7 is a perspective view illustrating an embodiment of the light source for a projector according to the present invention.

Referring to FIGS. 5, 6 and 7 which shows a second embodiment of the present invention, a reflector has a structure in which it is split into two at a plane containing the optical axis of the reflection surface thereof (refer to 7*d*, 7*c* in FIG. 5, 7*e*, 7*f* in FIG. 6, and 7*g*, 7*h* in FIG. 7). It is desirable that the portions which are bi-split from each other at the plane containing the optical axis of the reflection surface are a reflector portion made of heat-resistant glass, and a reflector portion made of heat-resistant organic resin. However, in a practical use, if a sufficient margin can be obtained for the thermal deformation temperature, the portions which are obtained being bi-split from each other at the plane containing the optical axis of the reflection surface may be made of one kind of a material such as a heat-resistant organic material.

Referring to FIG. 5, if the reflector has a configuration which is vertically symmetric, it is possible to aim at commonly using the dies so as to exhibit such an advantage that the mass-production cost may be reduced. Further, with the provision of similar heat radiation fins 12 in the lower part of the reflector 7*c*, in addition to the heat radiation fins 11 provided in the upper part of the external wall surface of the reflector 7*d*, the efficiency of heat radiation can be further enhanced.

Figure 8:
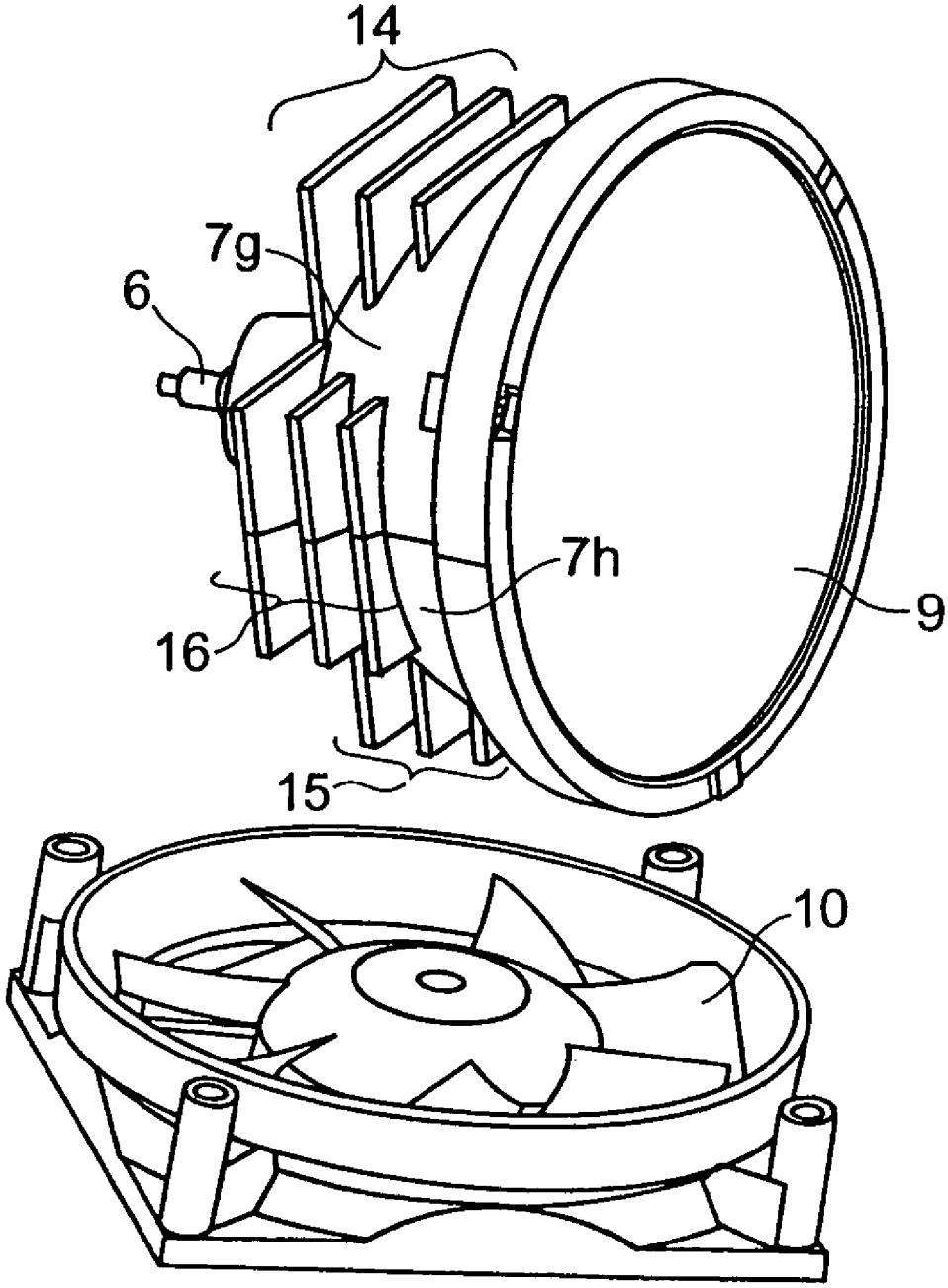
FIG. 8 is a view illustrating a layout of a use configuration of the light source for a projector according to the present invention as a light source for an optical instrument such as a liquid crystal projector.

Referring to FIG. 6, similar heat radiation fins 15 are added to the reflector 7*f* in the lower part, in addition to the heat radiation fins 14 provided in the upper part of the outer wall surface of the reflector 7*e*. The configuration of the reflector shown in FIG. 8 is the same as that of the reflector shown in FIG. 5, except that the direction of the provision of the fins is orthogonal to the optical axis of the reflector. Depending upon a direction of a stream of air for cooling the reflector (depending upon a position where the fan is attached) the efficiency of heat radiation can be further enhanced.

Further, referring to FIG. 7, with the provision of the heat radiation fins 14 in the upper part of the external wall surface of the reflector 7*g*, the heat radiation fins 15 in the lower part of the external wall surface of the reflector 7*h* and heat radiation fins 16 in the left and right side parts of the external surface (the heat radiation fins 16 on the left side part of the external wall surface are not shown), which are symmetric with respect to the axis of the lamp bulb, it is possible to obtain a further excellent heat radiation capability. In FIGS. 5, 6 and 7, like reference numerals are used to denote like parts to those shown in the figures previously explained, and accordingly, explanation thereto will be omitted.

It is noted that although the explanation has been made with reference to FIGS. 5, 6 and 7 such that the reflector is split into two at a plane containing the axis of the reflection surface, the present invention should not limited to this configuration. It should be manifest that essential feature of the present invention is to aim at commonly using the dies so as to reduce the mass production cost, and accordingly, the reflector which is rotationally symmetric may be split into not less than two such as four by planes containing the optical axis of the reflection surface.

In the case of using only one kind of a heat-resistant organic material is used as a material of which the reflector is formed, since there is presented such a problem that the reflector having a focal distance of not greater than 4 mm causes no margin with respect to the heat resistant temperature, and the input power exceeding 250 W also causes no margin with respect to the heat resistant temperature, an extra-high pressure mercury lamp having an input power of not greater than 250 W and a reflector having a focal distance not less than 4 mm are preferably combined with each other. The inter-electrode distance of the extra-high pressure mercury lamp is set to a value not greater than 1.8 mm. Should it exceed 1.8 mm, the luminous efficiency would be lowered.

Referring to FIG. 8 which shows a configuration of using the reflector shown in FIG. 7, according to the present invention for a light source for an optical instrument such as an actual liquid crystal projector or an overhead projector, a cooling fan 10 is provided at the lower surface of a projection light source device so as to blow air onto the reflectors 7*g*, 7*h* provided with heat-radiation fins in order to enhance the cooling efficiency. Further, in another method, air around the light source which has been heated after the light source is turned on may be sucked out so as to create a stream of air in order to cool the reflector.

In the cases shown in FIGS. 3 and 5, and 6, 7 and 8, the directions of the heat radiation fins are different from one anther, if the light source is mounted as a projection light source device in a projection type image display apparatus, it is natural to provide the heat radiation fins in a direction parallel to the stream of air blown from a cooling fan, and as a result, the heat radiation can be made with an extreme high degree of efficiency.

Next, explanation will be made of a third embodiment in which the reflector is split into three portions with reference to FIGS. 23 to 28. In FIGS. 23 to 28, like reference numerals are used to denote like parts to those shown in the figures which have been explained hereinabove, and accordingly, detailed explanation thereto will be omitted.

Figure 23:
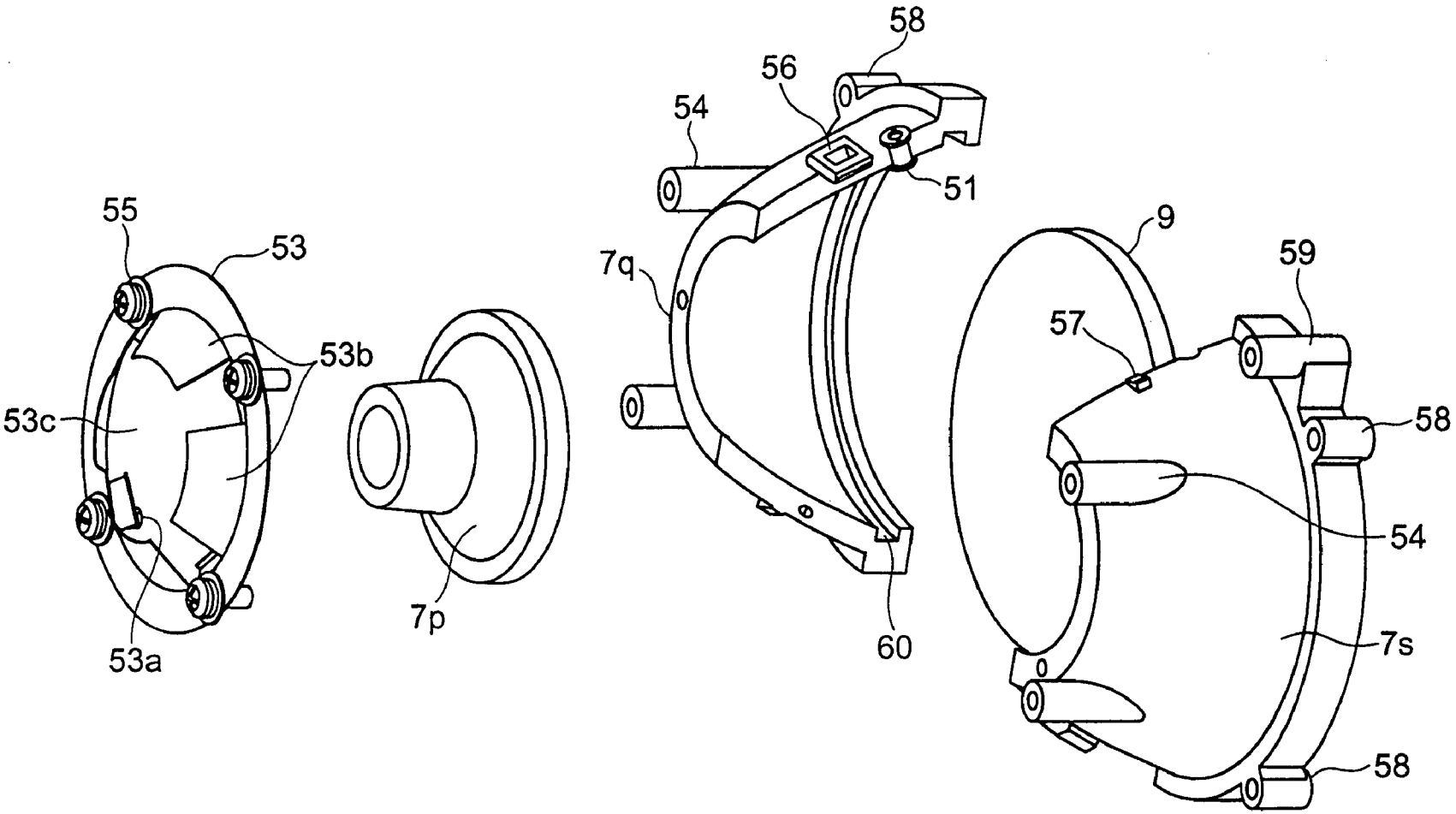
FIG. 23 is an exploded perspective view illustrating a reflector split into three portions.
Figure 24:
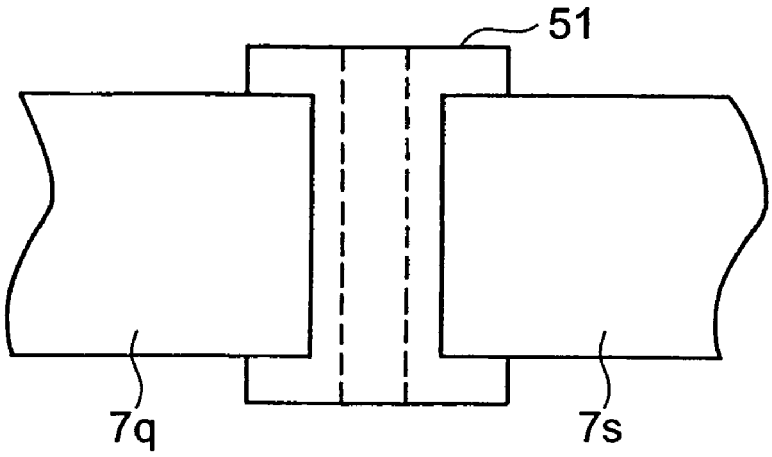
FIG. 24 is a sectional view illustrating an insulation sleeve.

Referring to FIG. 23 which is an exploded perspective view illustrating a reflector split into three portions, the reflector is composed of a first reflector 7*p* having a small bore diameter, provided on the bottom surface side of the reflector adjacent to the arc tube serving as a heat source, and made of heat-resistant glass (having a thermal deformation temperature from about 500 to 600 deg.C.), and second reflectors 7*q*, 7*s* which are remote from the light bulb of the arc tube in the direction of light projection and which are made of a heat-resistant organic material as a base material. The second reflectors 7*q*, 7*s* are obtained by bi-splitting the reflector on the opening side at a plane containing the optical axis of the reflection surface, and are symmetric with each other, having their reflection surfaces coated thereover with a metal thin film made of aluminum, silver, silver alloy or the like. The reflection surface of the first reflector 7*p* is coated thereover with an optical multilayer film made of $TiO_2$ and $SiO_2$ as mentioned above.

The second reflector 7*q* is formed thereon with a pawl 56 in the vicinity of a split surface while the second reflector 7*s* is formed therein with a protrusion 57 at a position corresponding to the pawl 56, and accordingly, the second reflectors 7*q* and 7*s* are assembled to each other by fitting the pawl 56 and the protrusion 57 to each other. Further, on the contrary, in vicinity of the other split surfaces of the second reflectors 7*q*, 7*s*, the second reflector 7*q* is formed thereon with a protrusion 57 while the second reflector 7*s* is formed thereon with a pawl 56, that is, they are configured so as to be symmetric with respect to each other.

Further, the second reflectors 7*q*, 7*s* are provided with fixing bosses 54, two for each, for assembling them to the first reflector 7*p*. An attachment fixture A53 is used for attaching the first reflector 7*p* to the second reflectors 7*q*, 7*s*. The attachment fixture A53 is formed therein with an aperture 53*c* at its center. Further, in a peripheral ring part thereof is provided with four leaf-spring parts 53*a* which are resilient members inclined toward the center of the opening side of the reflector, and four air guide plates 53*b* which are planar members inclined in a direction reverse to the direction of the inclination of the spring parts 53*a*. The four spring parts 53*a* and the four air guide plates 53*b* are alternately attached along the circumferential direction of the ring part. Further, the bottom part of the first reflector 7*p* is inserted in the center aperture 53*c* of the attachment fixture A53, and the first reflector 7*p* is retained by the resiliency owned by the four spring parts 53*a* of the attachment fixture A53. Further, it is fixed to the fixing bosses 54 by means of screws 55 so as to press and fix the first reflector 7*p* to the second reflectors 7*q*, 7*s* in order to assemble the single reflector. As to the spring parts 53*a*, explanation will be made with reference to a part (a) in FIG. 27. Further, the second reflectors 7*q*, 7*s* are formed therein with grooves 60 in which a front glass panel 9 can be fastened and held.

The second reflectors 7*q* and 7*s* are formed in their split surface with semi-cylindrical recesses which are used for clamping a power line composed of a lead wire (which is not shown) and a spool-like insulator sleeve 51 for insulating the lead wire, for supplying a power to the light emitting tube (lamp) 1. As shown FIG. 24 which is a sectional view illustrating the insulating sleeve, the split surfaces of the second reflectors 7*q*, 7*s* are fastened in a recessed semi-cylindrical part so as to hold the insulator sleeve 51 therebetween. Since the metal thin films are formed on the reflection surfaces of the second reflectors 7*q*, 7*s*, the lead wire (which is not shown) for the lamp has to be insulated, and accordingly, the lead wire (which is not shown) is led through the hole of the insulator sleeve 51 for insulation. If an optical multi-layer film is coated on the reflection surfaces of the second reflectors 7*q*, 7*s*, instead of the metal thin film, it is natural that the necessity of the insulator sleeve 51 may be eliminated. It is noted that there are shown in FIG. 23, a lamp base attaching boss 58 for fixing the lamp base to the reflector and a lead wire fixing boss 59.

As mentioned above, with the use of the above-mentioned heat-resistant organic material as a base material for the second reflectors 7*q*, 7*s*, satisfactory moldability can be obtained even though their external configuration is complicated, and accordingly, the reflector can be assembled in an extremely simple manner while the first reflector 7*p* on the bottom side of the reflector, adjacent to the arc tube, is made of heat-resistant glass so as to attain high heat-resistance. Further, since the second reflectors 7*q*, 7*s* have configurations which are symmetric with respect to each other, the dies can be commonly used, thereby it is possible to offer such an advantage that the mass production cost can be reduced.

Figure 25:
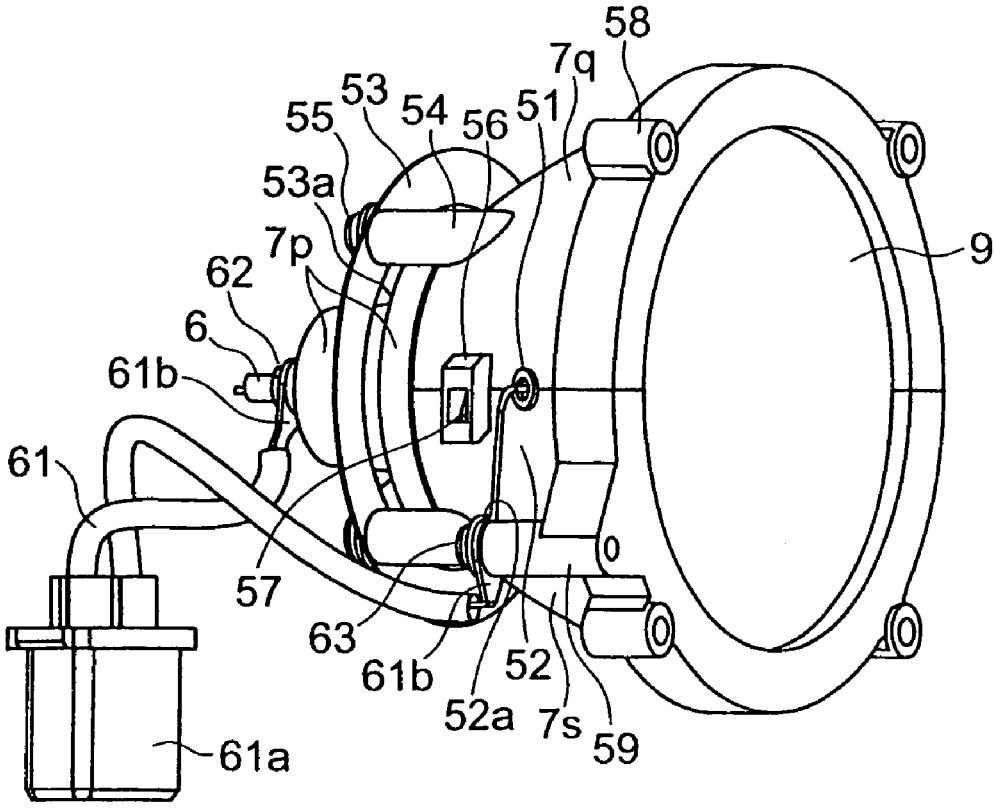
FIG. 25 is a light source for a projector which is assembled with the use of the reflector split into three portions shown in FIG. 23.
Figure 26:
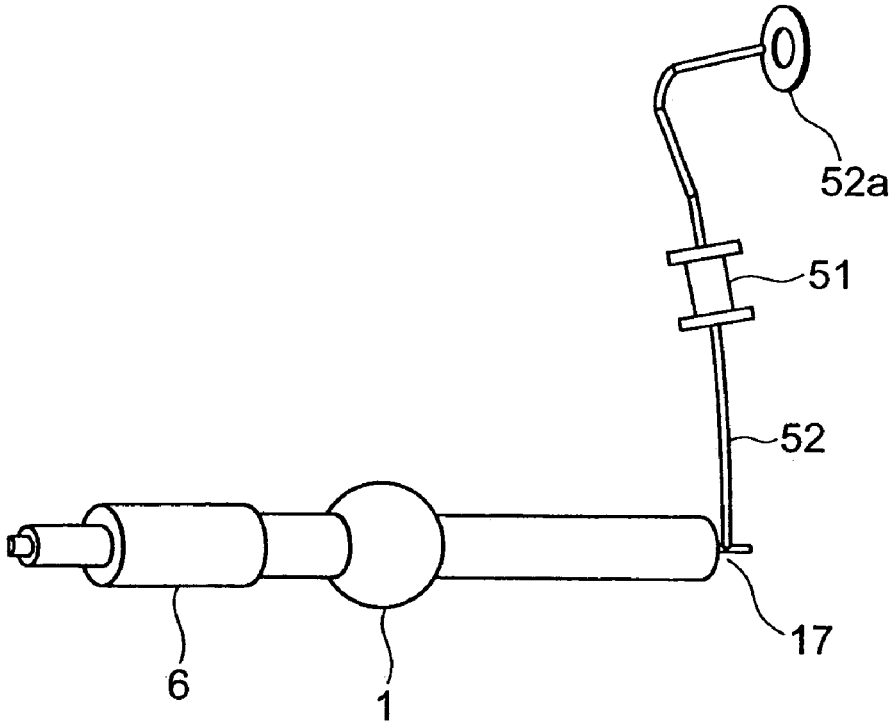
FIG. 26 is a view illustrating a configuration of a lamp.

Referring to FIG. 25 which shows a light source assembled with the use of the three-split reflector shown in FIG. 23, the lead wire 52 for power supply connected to the lamp on the side remote from the base 6 of the lamp, is led out from the hole of the insulator sleeve 51 having its leading end which is welded or is made into a press contact with a metal terminal 52*a* formed therein an aperture. Further, a power source connector 61 for supplying a power to the light source is connected on one side to a power source which is not shown, through the intermediary of a housing 61*a*, and on the other side to two lead wires which are welded or made into press-contact with metal terminals 61*b* each having an aperture at its leading end, one of the two lead wires being fixed and connected to the base 6 through the intermediary of the metal terminal 61*b* by means of a nut 62 while the other one thereof is fixed and connected to the lead wire fixing boss 59 by means of a screw 63 together with the metal terminal 52*a* of the lead wire 52, and is thus electrically connected to the other side of the lamp. With this arrangement, as shown in FIG. 26, such a preparation that the lead wire 52 is led through the sleeve 51 while the metal terminal 52*a* is welded or made into press-contact to one of the lead wires 52, and the other is welded or made into press-contact to the lamp can be made with the lamp itself. Accordingly, it is possible to eliminate the necessity of provision of a lead wire fixture 19 as a relay. Further, it is not necessary to weld or make the lead wire into press-contact on the way of the assembly, thereby it is possible to simplify the assembly.

Further, even if the lamp is broken or the reflection film peels off from the first reflector 7*p* due to any cause, the second reflectors 7*q*, 7*s* can be used continuously as it is, and accordingly, the light source can be reused by replacing the reflector 7*p* made of heat-resistant glass and the lamp as shown in FIG. 26 alone with new ones. Thus, there may be offered such an advantage that the serviceability is excellent. This is because the first reflector 7*b* can be optionally assembled or disassembled onto or from the second reflectors 7*q*, 7*s* by means of the attachment fixture A53, and the lead wire 52 welded to the light emitting tube (lamp) and the insulator sleeve 51 through which the lead wire is led, can be optionally attached or removed through the fitting between the pawl 56 and the protrusion 57. It is noted that the lamp is fixed to the first reflector 7*p* with the cement 8, and accordingly, both lamp and first reflector 7*p* have to be replaced with new ones at the same time.

Figure 27:
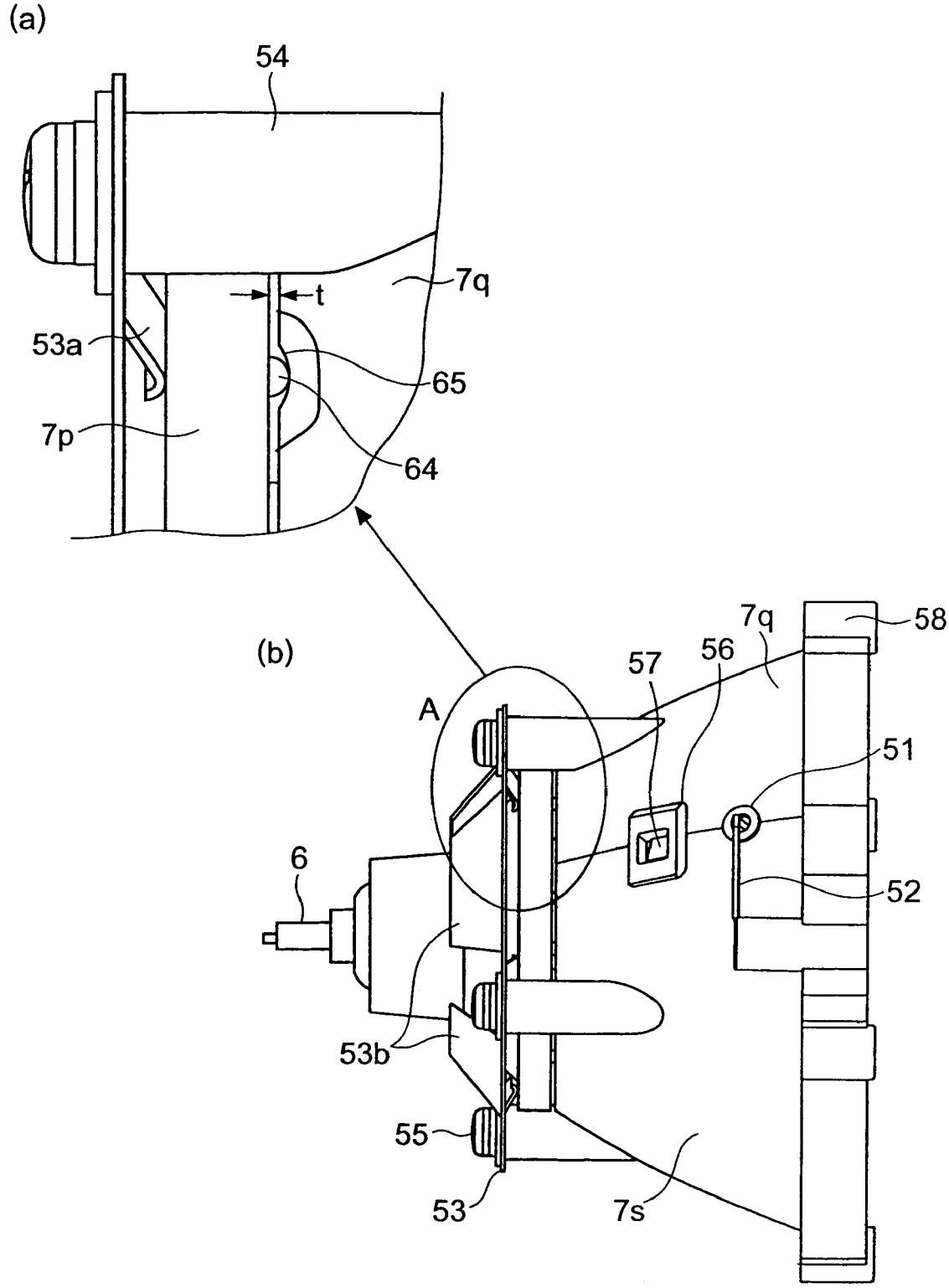
FIG. 27 is a view for explaining a method of fixing a first reflector 7*p* to second reflectors 7*p* and 7*s* in the light source shown in FIG. 25.

FIG. 27 is a view for explaining a method of fixing the first reflector 7*p* made of heat-resistant glass to the second reflectors 7*q*, 7*s* made of a heat-resistant organic material as a base material having a heat-resistance inferior to the heat resistant glass in the light source shown in FIG. 25, and (b) in FIG. 27 is an enlarged view illustrating the light source shown in FIG. 25, and (a) in FIG. 27 is an enlarge view illustrating a part surrounded by a circle A in (b). As shown in (a) in FIG. 27, the first reflector 7*p* has a plurality of semispherical protrusions 64, and the second reflectors 7*q*, 7*s* have recesses 65 which are semispherical recesses at positions corresponding to the protrusions 64. These protrusions 64 and the recesses 65 are fitted to one another so as to enable positional alignment between the first and second reflectors while the first reflector 7*p* and the second reflectors 7*q*, 7*s* are made into point-contact to each other. Thus, the contact area between the first reflector 7*p* and the second reflectors 7*q*, 7*s* can be reduced, and the heat conduction from the first reflector 7*p* having a high temperature to the second reflectors 7*q*, 7*s* having a low temperature can be reduced so as to enhance the margin for the allowable temperature of the heat-resistant organic material used as a base material for the second reflectors 7*q*, 7*s*. It is noted that the number of the protrusions 64 and the number of the recesses corresponding to the former are set desirably to three, respectively, since the number of three can ensure stable contacted. Further, the gap t between the first reflector 7*p* and the second reflectors 7*q*, 7*s* is set to a value from 0.1 to 2 mm. With the provision of the gap between the first reflector 7*p* and the second reflectors 7*q*, 7*s*, the heat conduction from the first reflector 7*p* to the second reflectors 7*q*, 7*s* can be restrained by the air layer in the gap, and convention heat in the light source can be expelled through this gap. Even though if the gap t is larger, the heat conduction can become lower, the light from the light source would possibly leak therethrough. Thus, the gap is desirably set to a value not greater than 2 mm.

(a) in FIG. 27 shows a spring part 53*a* shown in FIGS. 23 and 25, being enlarged in order to clearly understand the same. The first reflector 7*p* is pressed against and fixed to the second reflectors 7*q*, 7*s* with the resiliency owned by a leaf-like planar piece from which the spring part 53*a* is formed. Incidentally, it goes without saying that the fixing method shown in FIG. 27, can be applied to the first embodiment shown in FIGS. 3 and 4.

Figure 28:
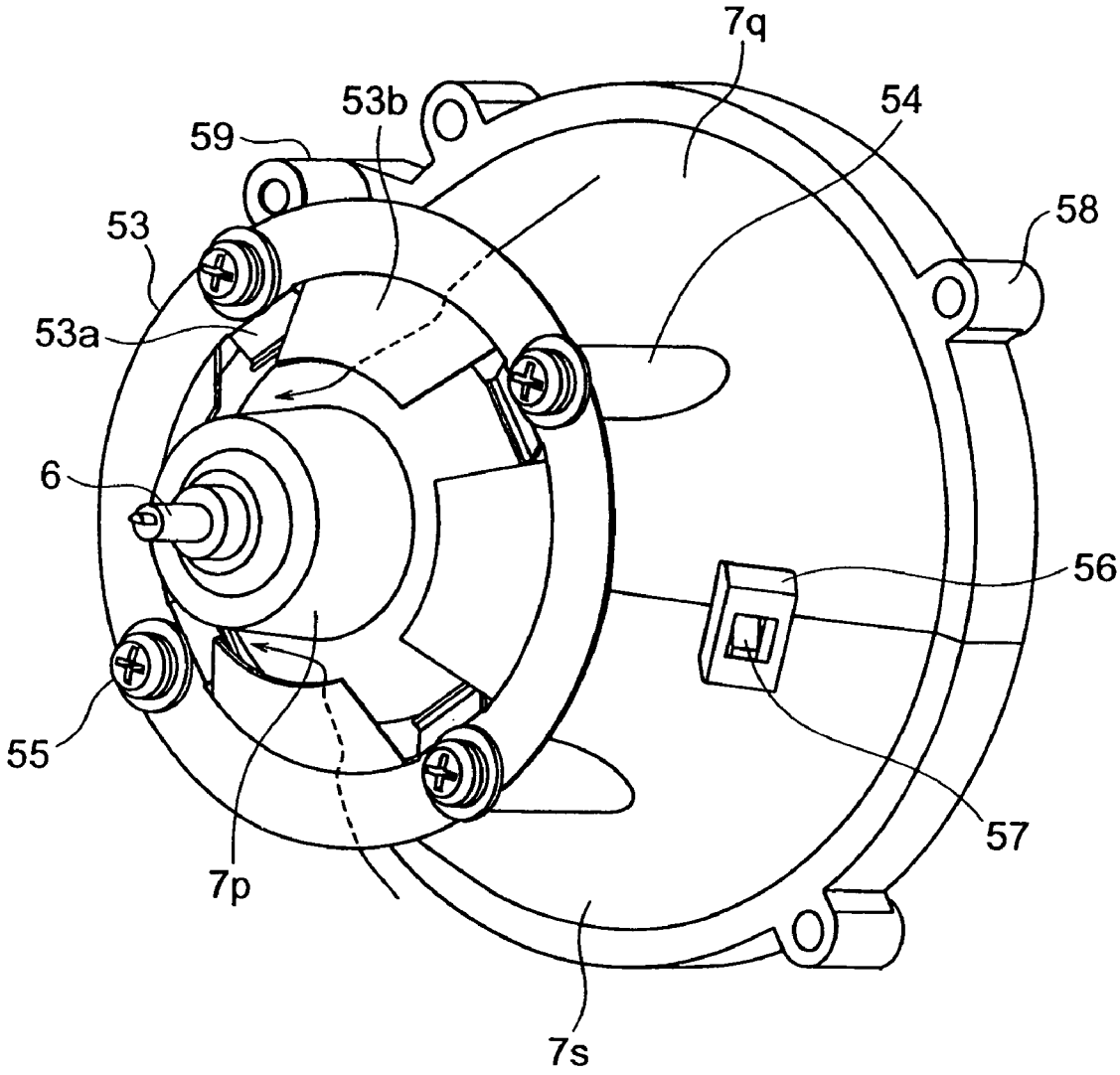
FIG. 28 is a perspective view illustrating the light source shown in FIG. 25 as viewed from the rear side thereof.

Next, explanation will be made of the function of the air guide plates 53*b* in the attachment fixture A53 with reference to FIG. 28 which shows the light source shown in FIG. 25, as viewed obliquely from the rear side thereof with the power source connector is eliminated. As clearly understood from FIG. 28, the air guide plates 53*b* are inclined toward the base 6 in order to define a gap between them and the outer wall of the first reflector 7*p*. If the air is exhausted in a direction from the rear surface of the light source in order to cool the light source, with the use of the cooling fan (which is not shown), the air flows through the gap between the first reflector 7*p* and the air guide plates 53*b* as indicated by the arrows, and accordingly, the first reflector 7*p* having a high temperature can be cooled with a high degree of efficiency.

Figure 29:
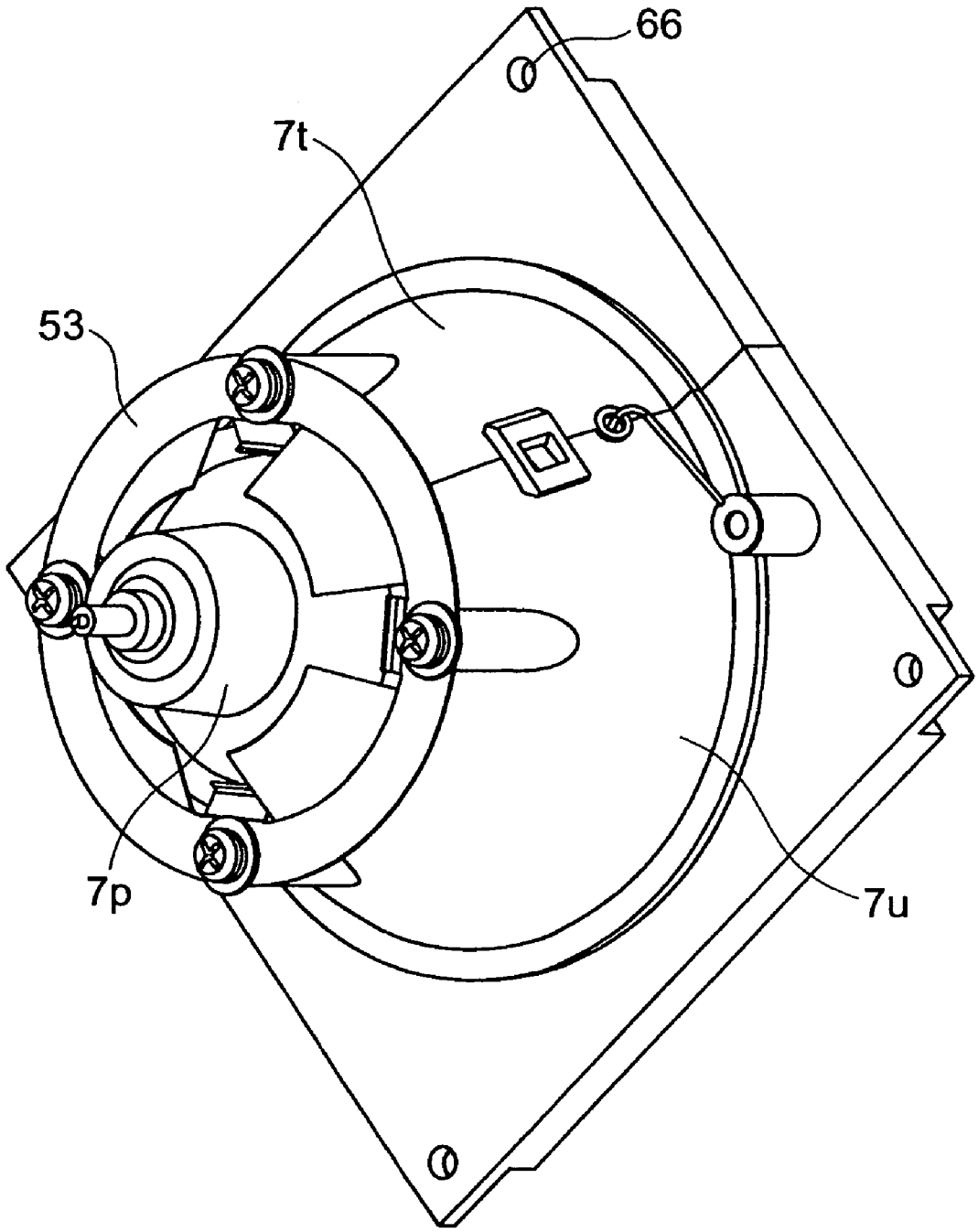
FIG. 29 is a view illustrating a fourth embodiment of the present invention.

Referring to FIG. 29 which shows a fourth embodiment, the lamp base which is split into two portions which are integrally incorporated with reflectors 7*q* and 7*s*, respectively, and a second reflector 7*t* is formed by integrally incorporating one of the two split positions of the lamp base, to the second reflector 7*q* shown in FIG. 25, and a second reflector 7*u* is formed by integrally incorporating the other one of the two split portions of the lamp base to the second reflector 7*s* shown in FIG. 25. Thus, the lamp base is integrally incorporated with the reflectors so as to reduce the number of components of the light source. Even in this embodiment, the second reflectors 7*t* and 7*u* are symmetric with each other. It is noted that the power source connector is eliminated from FIG. 29, further, like reference numerals are used to denote like parts to those shown in the figures which have been explained hereinabove, and explanation thereto will be omitted.

Figure 30:
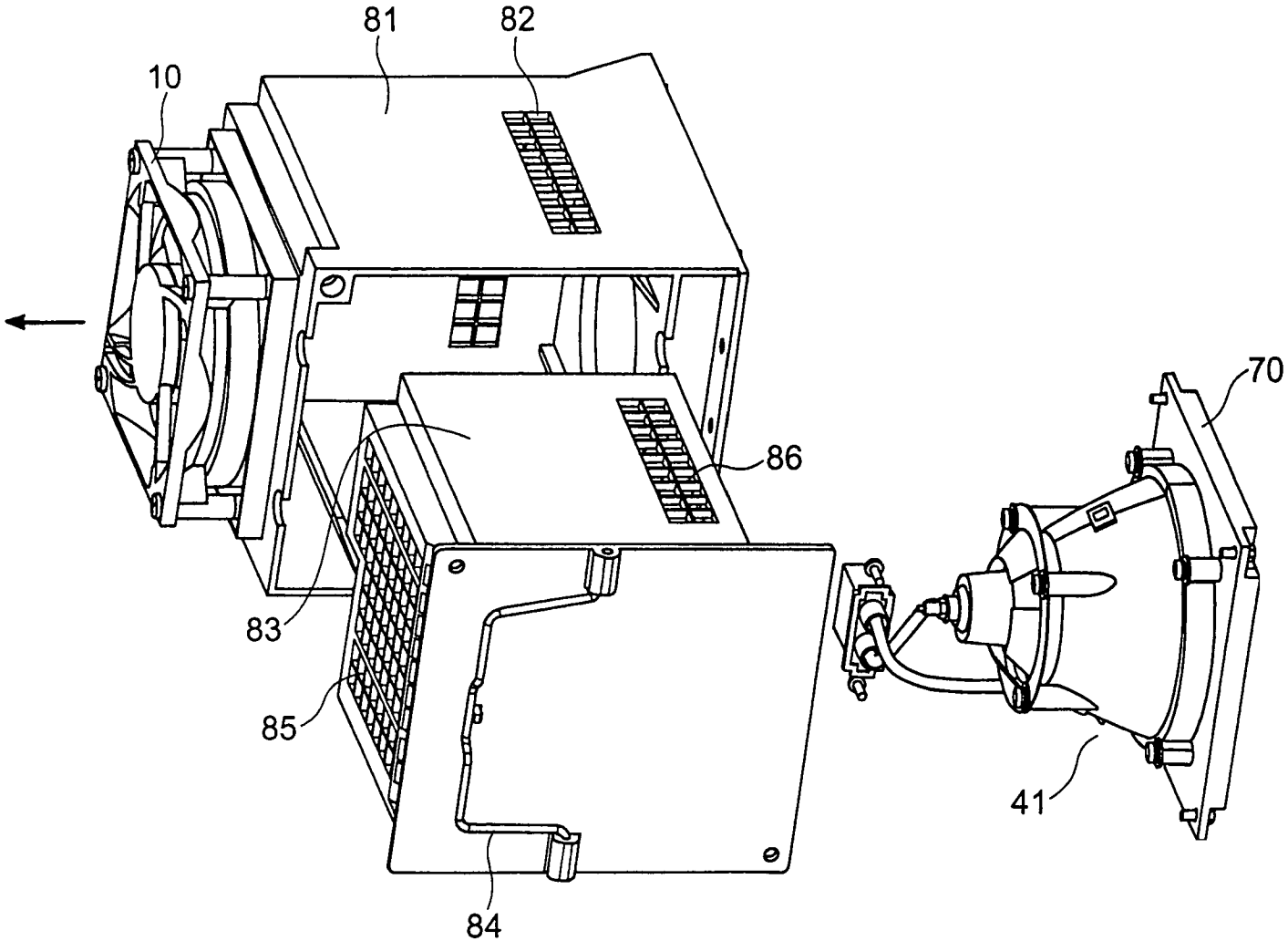
FIG. 30 a view illustrating a layout of a projection type image display apparatus in which the light source is used.

In general, the light source 41 is attached to a lamp base panel 70 which is then accommodated in a lamp casing 83, and the lamp casing 83 is in turn accommodated in a lamp housing 81 which incorporates therein a cooling fan 10 for exhausting air at the rear surface so as to cool the light source, while an air intake port 82 is formed in the wall surface thereof in a direction different from the direction of the projection of light from the light source, as shown in FIG. 30. The lamp housing which is composed as mentioned above, is incorporated in a projection type image display apparatus, and accordingly, the replacement of the light source with a new one can be made by the user or a service man. The lamp casing 83 has an exhaust port 85 in the rear surface on the cooling fan 10 side, and an air intake port 86 at a position corresponding to the air intake port 82. Further, there is shown a lamp casing handle 84 which is used when the lamp casing 85 is withdrawn.

Conventionally, since the reflector has been made of heat-resistant glass, the lamp base panel has been disable to be integrally incorporated with the reflector. However, according to the present invention, since the heat-resistant organic material which can be simply molded, is used as a base panel material for the reflector on the opening side, and further, since the reflector on the bottom side is made into point contact with the reflector on the opening side, as explained with respect to the light source shown in FIG. 25, the temperature of the lamp base panel attached to the reflector on the opening side can also be lowered (to a value around a room temperature of about 100 deg.C.), and accordingly, the bi-split second reflectors 7*q*, 7*s* on the opening side can be integrally incorporated with the lamp casing which is split into two portions. This configuration of this embodiment is that shown in FIG. 29, as mentioned above.

Figure 31:
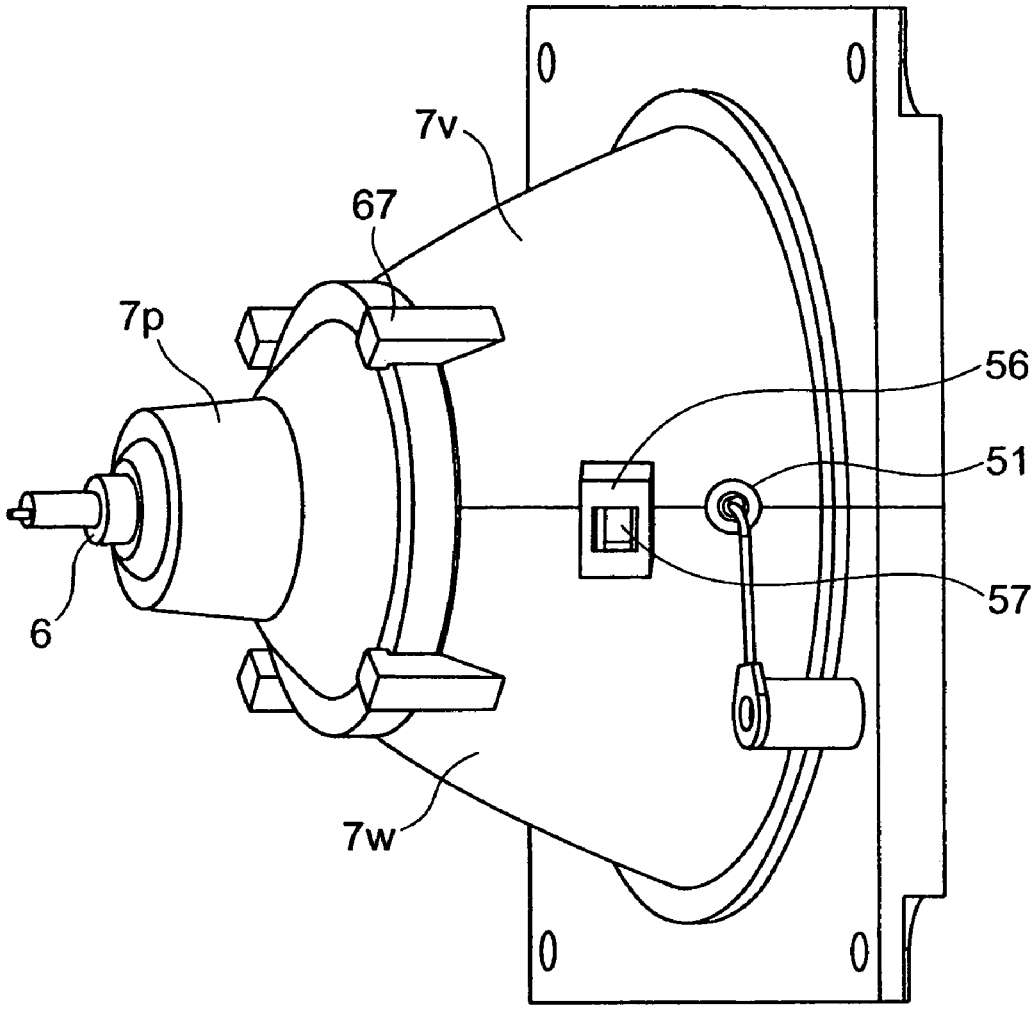
FIG. 31 is a view illustrating a fifth embodiment of the present invention.

Next, referring to FIG. 31 which shows a fifth embodiment of the present invention, and which is a view for explaining a method of fixing reflectors 7*v*, 7*w* integrally incorporated with the lamp base panel on the opening side, to the first reflector 7*p* on the bottom side by using pawls, without using the attachment fixture A53 for assembling them, the second reflectors 7*v*, 7*w* on the opening side are formed thereto with a plurality of pawls 67 (which are two for each of them in this figure) for fixing them to the first reflector 7*p* on the bottom side, and with the use of the pawls 67, the first reflector 7*p* can be fixed. With this arrangement, it is possible to eliminate the necessity of the attachment fixture A53*m*, thereby it is possible to reduce the costs. Further, without the necessity of fastening screws, the use of a screw fastening driver is not required, thereby it is possible to offer such an advantage that the manhours for the assembly thereof can be reduced. It is noted that the reference numerals are used in FIG. 31 to denote like parts those shown in Figures which have been explained hereinabove, and detail explanation thereto will be omitted.

The embodiments with reference to FIGS. 23 to 28 and FIGS. 29 and 31, no heat radiation fins as shown in FIGS. 3, 5 and 6, are incorporated to the bi-split second reflectors made of the heat-resistant organic material, the invention should not be limited to these embodiments, and heat radiation fins may also be incorporated therein.

With reference to FIGS. 23 to 31, explanation has been made of the embodiments in which the reflectors is split into three portions (composed of the first reflector made of heat-resistant glass, and the second reflectors into which the reflector is bi-split at a plane containing the optical axis and which are made of a heat-resistant organic material), the present invention should not be limited to these embodiment. It is clearly understandable that the opening side of the reflector made of the heat-resistant organic material as a base material may be split into not less than two portions, that is, for example, four portions at planes containing the optical axis of the reflection surface of the reflector which is rotationally symmetric. With this arrangement, the dies can be commonly used. Further, it is natural that the reflector on the bottom side, made of the heat-resistant glass, may be also split into more than 2 portions at planes containing the optical axis of the reflection surface of the reflector.

The heat-resistant organic material can exhibit satisfactory moldability even though a molded article has a complicated external configuration, as has been already stated hereinabove, and accordingly, with the provision of the heat radiation fins on the external wall of the reflector made of the heat-resistant organic material, the heat radiation surface can be increased so as to enhance the heat radiation capability. However, as another method, concavities and convexities (which are fine) may also formed in the surface of the external wall of the reflector. This method is advantageous since it can be applied not only for the outer wall of the second reflector but also for that of the first reflector made of the heat-resistant glass.

As another method of increasing the heat radiation area, bristles are planted to the outer wall of the reflector made of the heat-resistant organic material with the use of electrostatic painting. Synthetic fibers having a diameter from 30 to 50 μm and a length of 0.1 to 0.3 mm are blown onto the outer wall of the reflector made of the heat-resistant organic material with the use of electrostatic painting so as to increase the heat radiation area in order to enhance the heat radiation capability, and further, it may also offer such an advantage to reduce the risk of heat injury even though a human hand makes contact with the bristles on the outer wall since an air layer is created among the bristles.

The method of enhancing the heat radiation capability and reducing heat injury with the provision of the bristles, can be also applied to other parts having a high temperature. For example, since the interior of the lamp casing 83 (made of a plastic material) shown in FIG. 30, for accommodating therein the light source has a high temperature, the internal wall is planted thereon with bristles in order to increase the surface area of the internal wall so as to enhance the heat radiation capability. Further, bristles may also be planted to the external wall surface of the lamp casing to which the lamp casing handle 84 used for taking out the lamp casing 83 from the lamp house 81 during replacement of the lamp is attached, in order to reduce the risk of heat injury even though a human hand makes accidentally contact with the lamp casing 84 during replacement of lamps.

Figure 18:
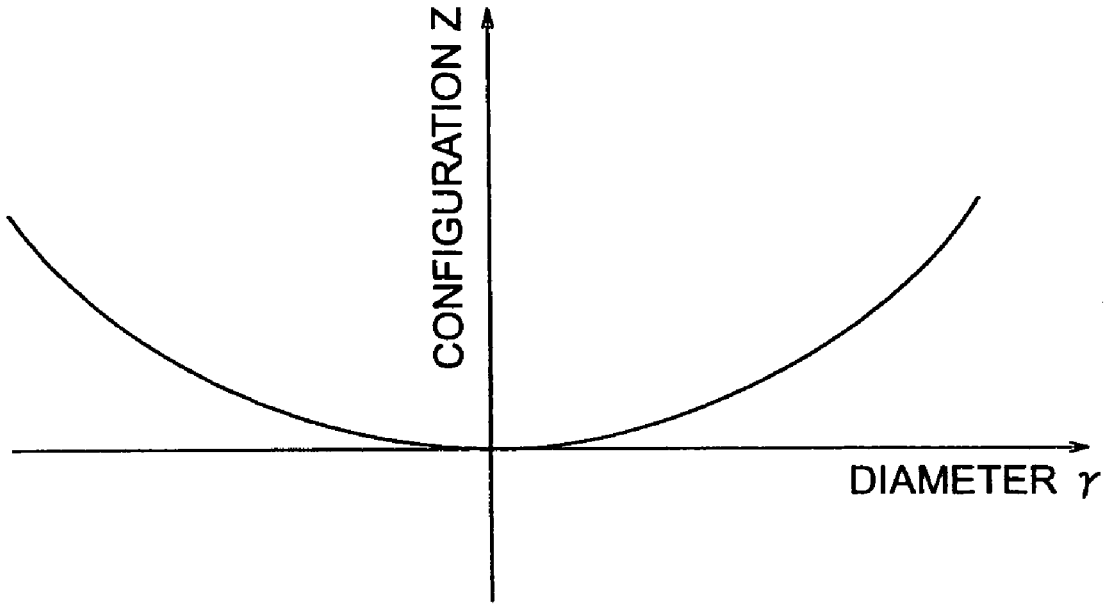
FIG. 18 is a view for explaining an aspheric configuration.

Next, explanation will be made of the predominance of the configuration of the internal wall surface (reflection surface) of the reflector 7 containing a high order coefficient not less than fourth-order. Z(r) found in formula 1 exhibits a height of the reflector surface as shown in FIG. 18 which is a view for explaining a configuration of a lens and in which the direction (the axial direction of the lamp) from the bottom part to the opening part of the reflector is taken on the Z-axis while the radial direction of the reflector is taken on the R-axis, where r is a radial distance, and RD is a radius of curvature, CC, AE, AF, AG, AH . . . are arbitrary constants, n is an arbitrary nonnegative integer. Accordingly, if the factors Cc, AE, AF, AG, AH . . . are known, the height of the reflector surface, that is the configuration of the reflector can be determined in view of the following formula 1:

$$z(r) = (1/RD)r^2 \Big/ \left[1 + \sqrt{1-(1-CC)r^2(1/RD)^2}\right] + AE*r^4 + AF*r^6 + AG*r^8 + AH*r^{10} + \ldots + AR*r^n \quad \text{(formula 1)}$$

In the above-mentioned formula 1, if the sectional shape indicating the configuration of the reflection surface of a conventional reflector is circular, only the factor RD is present so as CC=0, while in the case of a parabolic sectional shape, RD is give and CC=−1, but in the case of an elliptic sectional shape, RD is given, and if −1<CC<0, an elliptic shape which is rotationally symmetric. about the major axis, is obtained but if 0<CC, an elliptic shape which is rotationally symmetric about the minor axis is obtained.

On the contrary, the reflector according to the present invention, may easily have a high degree of configuration accuracy, and accordingly, the reflection surface with a high degree of accuracy can be obtained even though the configuration is complicated containing a high order coefficient not less than forth order.

Figure 12:
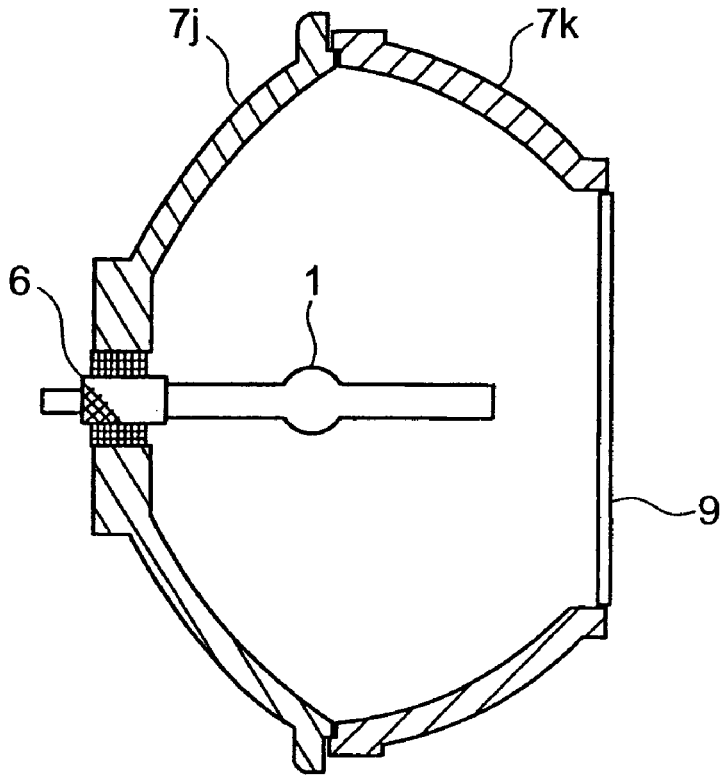
FIG. 12 is a sectional view illustrating a light source for a projector composed of a light source lamp and a composite reflector according to the present invention.

Referring to FIG. 4 which is a sectional view illustrating such a configuration that the reflector composed of the reflector portion 7*a* having a sectional shape of the reflection thereof as a part of a parabolic surface and made of heat-resistant glass, and the reflector portion 7*b* made of heat-resistant organic material, is jointed to the base 6 of the light bulb of the arc tube 1 by means of the cement 8. Further, FIG. 12 shows the configuration of the bi-split reflector in which the reflector 7*j* having an elliptic sectional shape of the reflection surface is jointed to the reflector 7*k* having a circular sectional shape while the reflector 7*j* is jointed to the base of the light bulb 6 of the arc tube 1 by means of the cement 8. In FIGS. 4 and 12, like reference numerals are used to denote like parts to those shown in FIG. 1, and detail explanation thereto will be omitted.

Conventionally, although designing has been made with such estimation that the light source is a light source point for the reflection surface of any reflector, an actual light source is not a point but has a definite length, having an energy distribution with an asymmetric light distribution.

Figure 13:
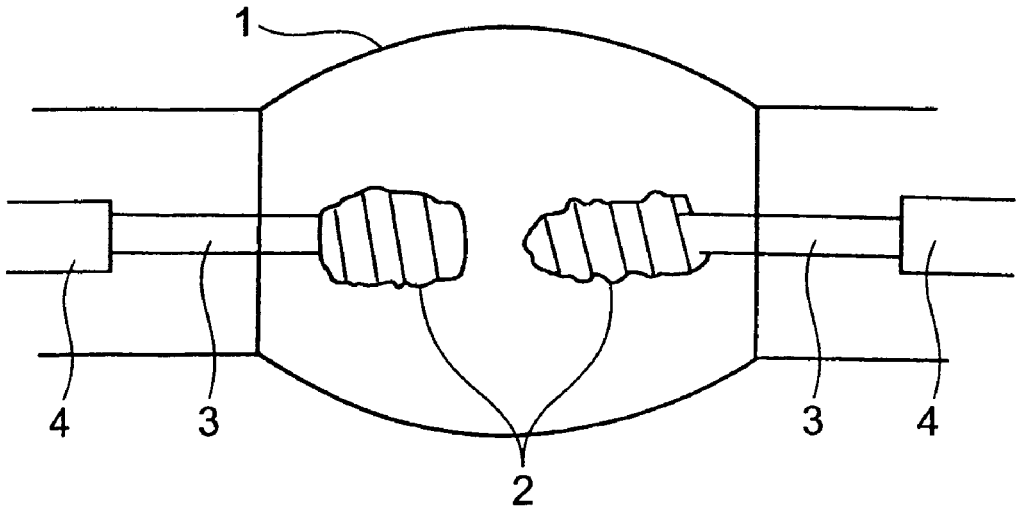
FIG. 13 is an enlarged sectional view illustrating a part of an extra-high pressure lamp around a bulb.
Figure 14:
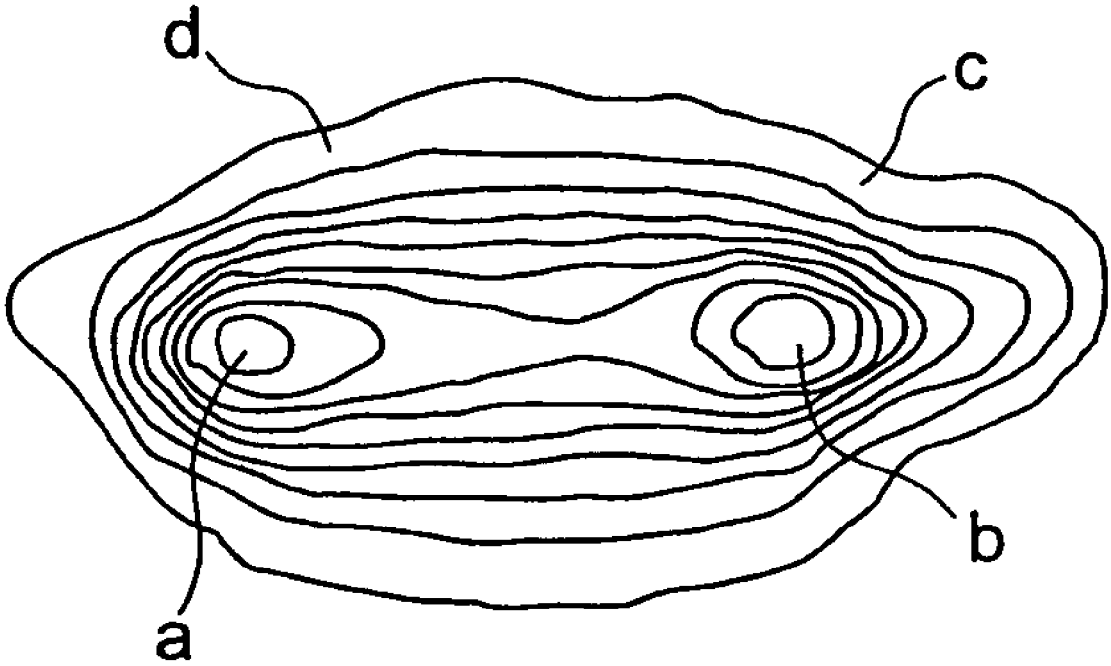
FIG. 14 is a view illustrating a distribution of luminescent energy around the bulb of the extra-pressure mercury lamp upon turn-on thereof.

Explanation will be made of a specific example. FIG. 13 is enlarged view illustrating an a.c. driven extra-high pressure mercury lamp used in the light source for a projector shown in FIG. 1, in a part around the bulb thereof, and FIG. 14 is a view illustrating a luminescent energy distribution of the lamp which is turned on. Referring to FIG. 13, a pair of electrodes 2 having an inter-electrode gap (arc length) with an effective length are present in a quartz glass tube 1. In a light bulb of 100 W class. This effective length is about 1.0 to 1.4 mm. Further, referring to FIG. 14, iso-luminescent energy closed curves obtained by successively connecting iso-luminescent energy points becomes iso-luminescent energy closed curves with two electrodes a, b as center points, in the vicinity of the electrodes a, b. Remote from the electrodes a, b, iso-luminescent closed curves containing therein and surrounding the two electrodes a, b are obtained. It is noted that c, d in FIG. 14 denote parts where the luminescent energy is low. As clearly understood therefrom, the luminescent energy distribution in the vicinity of the light bulb during turn-on of the lamp, is not uniform, but the brightness is highest in the vicinity of the two electrodes. That is, it is found that two light emitting points are present.

Figure 15:
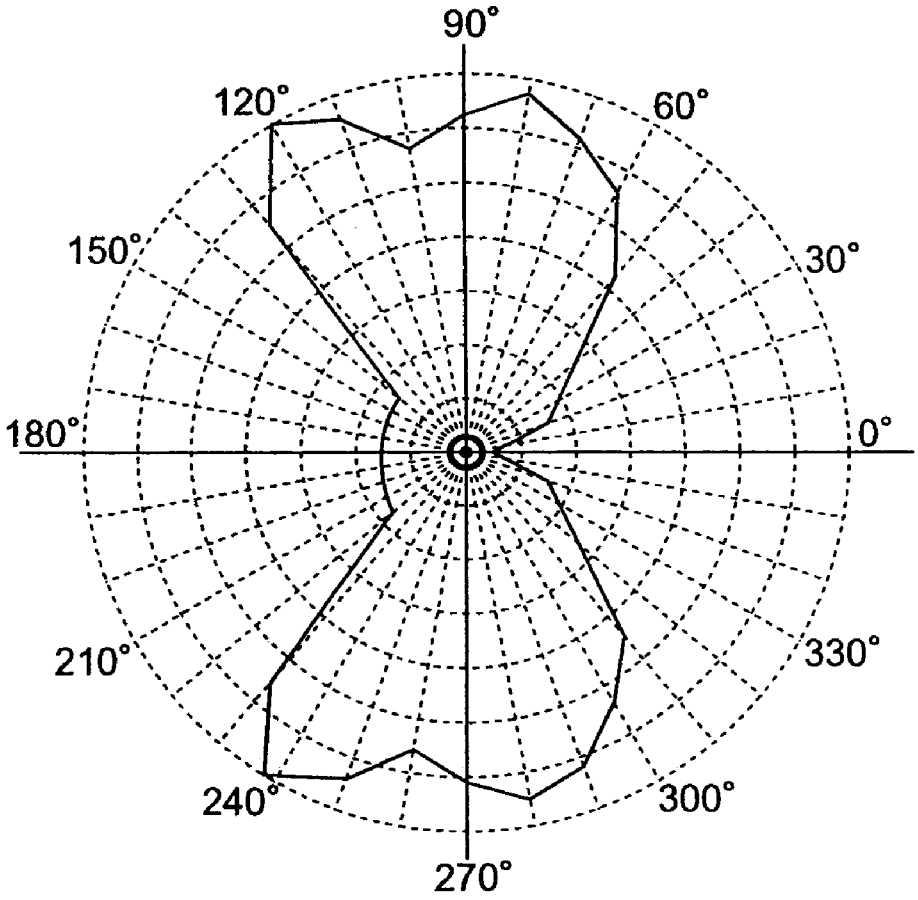
FIG. 15 is a view illustrating a light distribution characteristic of a d.c. drive type extra-pressure mercury lamp.
Figure 16:
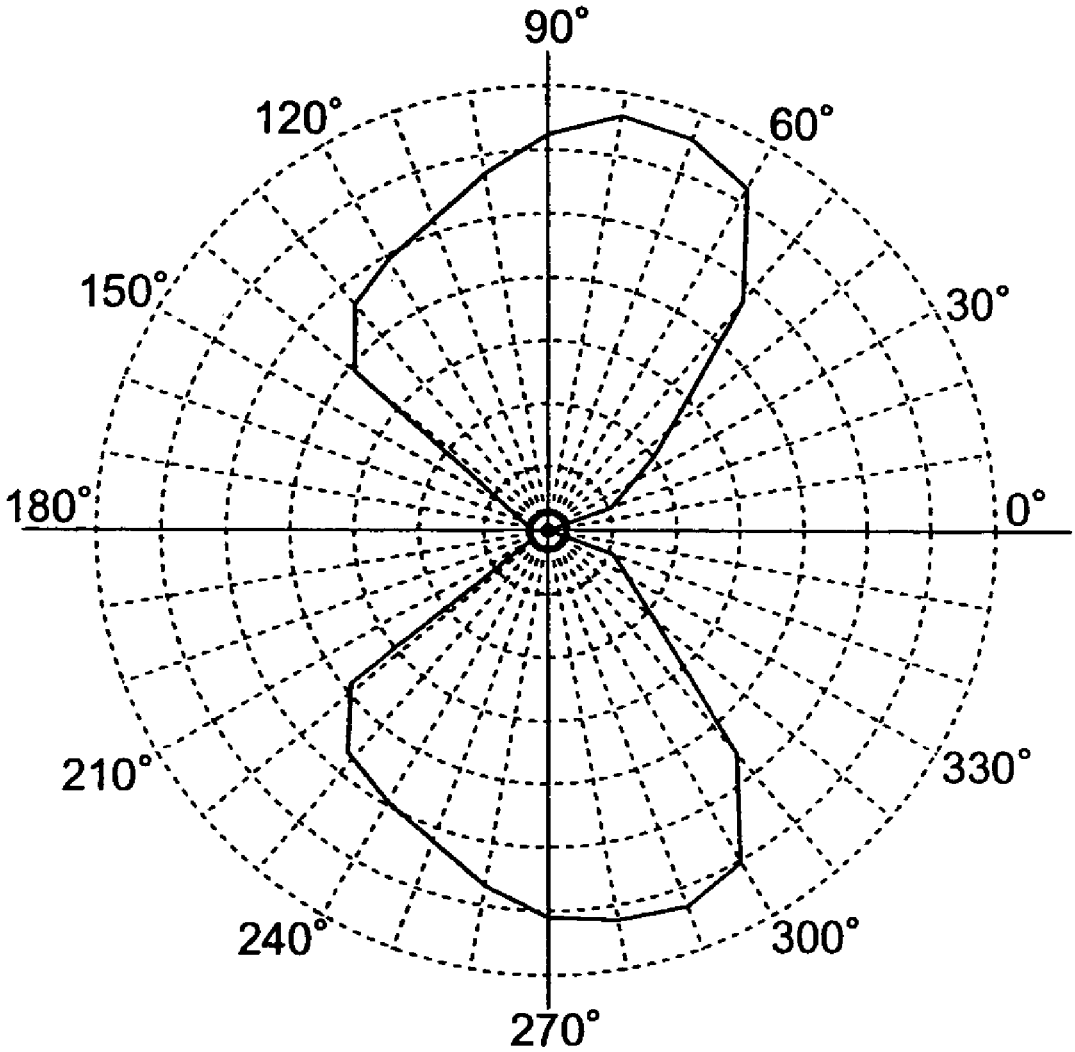
FIG. 16 is a view illustrating a light distribution characteristic of an a.c. drive type extra-pressure mercury lamp.

FIG. 15 shows a light distribution characteristic of a d.c. driven extra-high pressure mercury lamp, and FIG. 16 shows a light distribution characteristic of an a.c. driven extra-high pressure mercury lamp. The light distribution characteristic of the arc tube 1 is asymmetric with respect to an axis (from 90 to 270 deg. in the figure) orthogonal to the axis of the lamp (from 0 to 180 deg. in the figure), as shown in FIGS. 15 and 16. In particular, the light distribution of the d.c. driven extra-high pressure mercury lamp shown in FIG. 15, has asymmetry which is larger than that of the a.c. driven extra-high pressure mercury lamp shown in FIG. 16. This is because the dimensions of an anode electrode are in general greater than that of a cathode electrode in the d.c. driven extra-high pressure mercury lamp, and accordingly, the light is in part blocked on the anode side.

As have been stated, it is desirable that the present extra-high pressure mercury lamp is regarded as having not a single light source but two light sources, a reflector used in combination with the extra-high pressure mercury lamp has such a configuration that a plurality of focal points are present. In order to have a plurality of focal points in the reflector, coefficients having an order not less than fourth order in the above-mentioned formula 1 is indispensable, It is noted that the efficiency is contrarily lowered if the ark length exceeds 1.8 mm.

Figure 9:
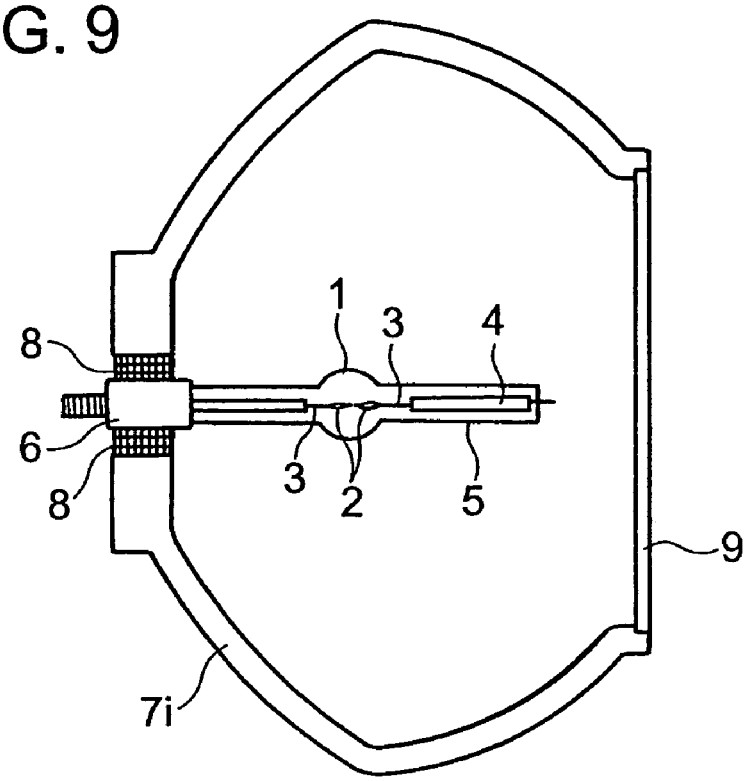
FIG. 9 is a sectional view illustrating a light source for a projector composed of a light source lamp and a reflector according to the present invention.
Figure 10:
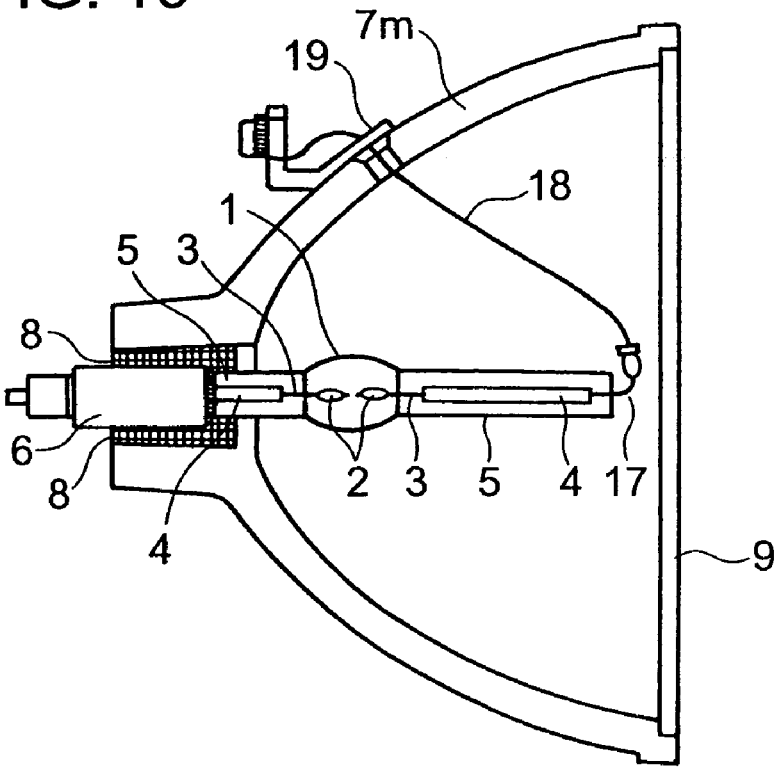
FIG. 10 is a sectional view illustrating a light source for a projector composed of a light source lamp and a reflector according to the present invention.

As stated above, explanation has been made of the predominance in the case of the configuration of the inner wall surface (reflection surface) of the reflector, which includes a coefficient of an order higher than the fourth order. Meanwhile, according to the present invention, the configuration of the reflection surface of the reflector resembling to a design configuration can be stably obtained with a high degree of accuracy, and accordingly, the internal wall surface (reflection surface) of the reflector can contain therein a coefficient of an order exceeding a fourth order. FIGS. 9 and 10 show another embodiment of the reflector according to the present invention. In FIGS. 9 and 10, like reference numerals are used to denote like parts to those shown in the figures which have been explained hereinabove, and detailed explanation thereto will be omitted. FIG. 9 shows such a configuration that the maximum diameter of the reflection surface of a reflector 7*i* becomes greater than the bore diameter of the opening on the light projection side of the reflector, and the configuration can be surely obtained by coefficients in accordance with the aspheric formula 1. Even with this configuration of the internal surface, the reflector which is bi-split at a plane containing the optical axis of the reflection surface can be materialized.

Similarly, FIG. 10 shows a reflector 7*m* having the bore diameter of the opening on the light projection side which is smaller than that of a parabolic reflection surface in view of the light distribution of the reflector. Similar to the embodiment shown in FIG. 9, this configuration can be surely obtained by coefficients in accordance with the aspheric formula 1. Even with this configuration of the internal surface, a reflector having a structure which is bi-split at a plane substantially parallel with the optical axis of the reflection surface can be materialized.

Incidentally, it is desirable that each of the bi-split parts which are separated from each other at a plane substantially parallel with the optical axis of the reflection surface is composed of a reflector part made of heat-resistant glass, and a reflector part made of heat-resistant organic material. It is noted here that if the margin is sufficient for the thermal deformation temperature of the heat-resistant organic material in a practical use, the parts which are separated from each other by a plane substantially parallel with the optical axis of the reflection surface may be made of only one kind of a material such as a heat-resistant organic material.

Figure 32:
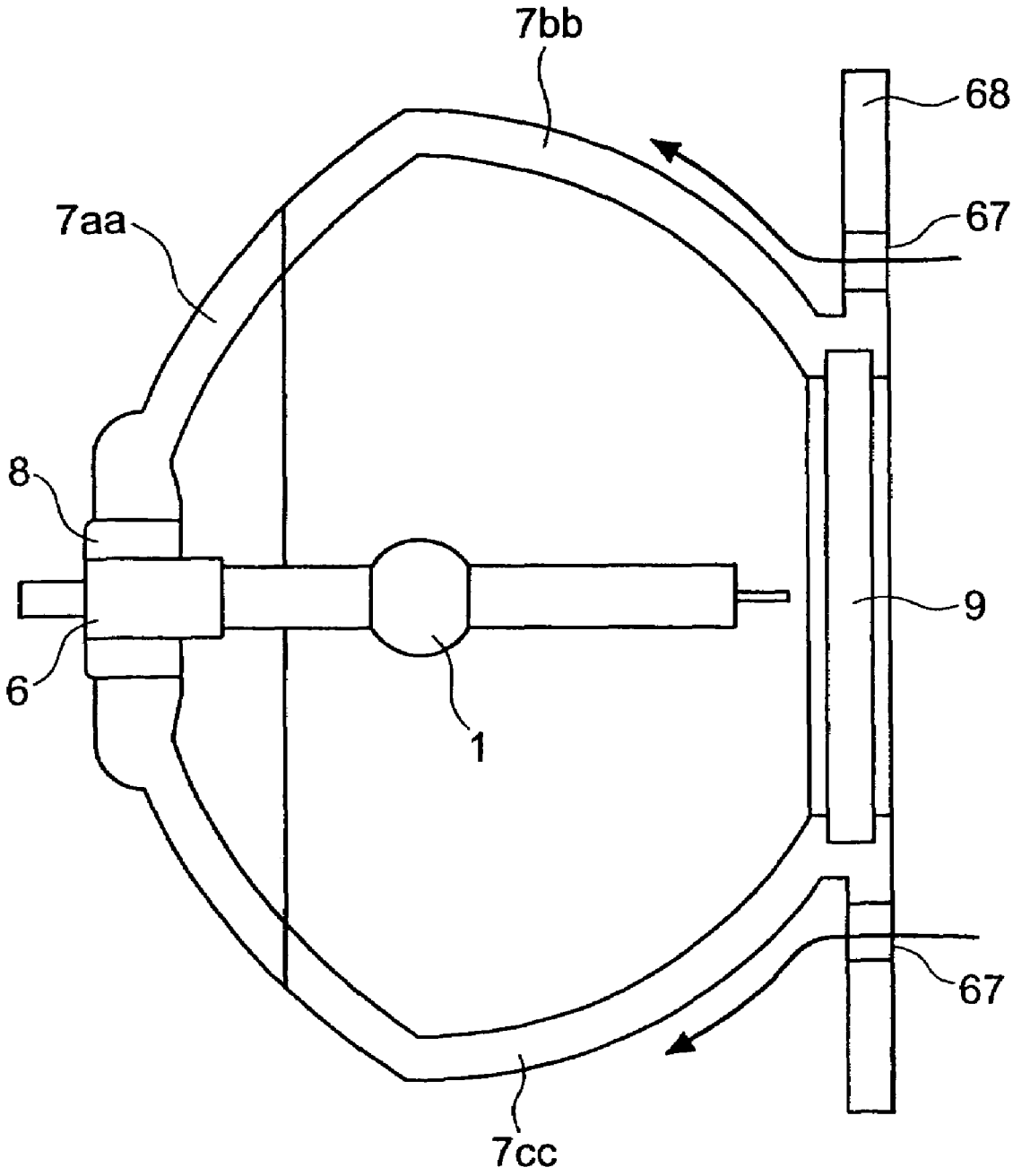
FIG. 32 is a view illustrating an embodiment of the reflector shown in FIG. 9 which is composed of the three split portions.

Next, FIG. 32 shows an embodiment in which three split portions of the reflector are applied to the configuration shown in FIG. 29. Referring to FIG. 32, the reflector is composed of a first reflector 7*aa* made of heat-resistant glass on the bottom side of the reflector, and two second reflectors 7*bb*, 7*cc* which are obtained by bi-splitting the opening side part of the reflector at a plane containing the optical axis of the reflection surface and which are made of a heat-resistant organic material as a base material. The second reflector 7*bb* is symmetric with the reflector 7*cc*. As have been explained hereinabove, since the bore diameter of the opening of the first reflector 7*aa* is small, it can be formed with a high degree of accuracy, even being made of heat-resistant glass, and further, since the reflectors 7*bb*, 7*cc* are made of a heat-resistant organic material as a base material, a free curved surface can be molded with a high degree of accuracy having a large bore diameter as shown in FIG. 32. Since the second reflectors 7*bb*, 7*cc* are molded being integrally incorporated with the bi-split lamp base panels, a plurality of air guide apertures 67 are formed in the lamp base panel 68 in the vicinity of a zone where the opening of the second reflectors 7*bb*, 7*cc* narrows toward the optical axis. If the air is exhausted from the rear side of the light source by means of the cooling fan 10 (which is not shown in this figure), the air flows through the apertures 67 and then along the curved surfaces of the outer walls of the second reflectors 7*bb*, 7*cc* so as to cool the reflector or the light source. Should no apertures 67 be present, no air would flow in the zone where the opening of the second reflectors 7*bb*, 7*cc* constricts and accordingly, the cooling effect in the zone would be low.

It goes without saying that, instead of those having a structure in which the reflector is bi-split at a plane containing the optical axis of the reflection surface in the embodiments stated hereinabove, a reflector which is bi-split at a plane shifted from the plane containing the optical axis may be included within the scope of the present invention even though it depends upon its configuration.

Meanwhile, as to a countermeasure to a punctured extra-high pressure mercury tube in the light source for a projector according to the present invention, the averaged wall thickness of the reflector is gradually increased from the front opening to the bottom opening thereof so as to possibly trap fragments scattered from a punctured light bulb glass tube within the reflector. The reason why the above-mentioned counter measure is taken, is such that strong impact is exerted to the bottom opening side of the reflector, near the light emitting tube. The minimum wall thickness of the reflector requires at least 2 mm, and if the moldability is regarded as being important, it is desirably set to a value not less than 3 mm. The averaged wall thickness of the bottom opening near the bulb may be desirably set to 5 mm. It was confirmed when the lamp bulb of the light emitting tube was burst during the use thereof, no fragments, no fragments were scattered outside of the reflector made of the above-mentioned BMC having a wall thickness of not less than 5 mm.

Further, with the provision of a front glass pane made of a material different from that of the reflector 7, it is possible to prevent fragments of the glass light bulb due to a burst thereof from scattering to a projection optical system. By covering each of both surfaces of the front glass pane with an antireflection coating, the reflection loss can be reduced.

Figure 11:
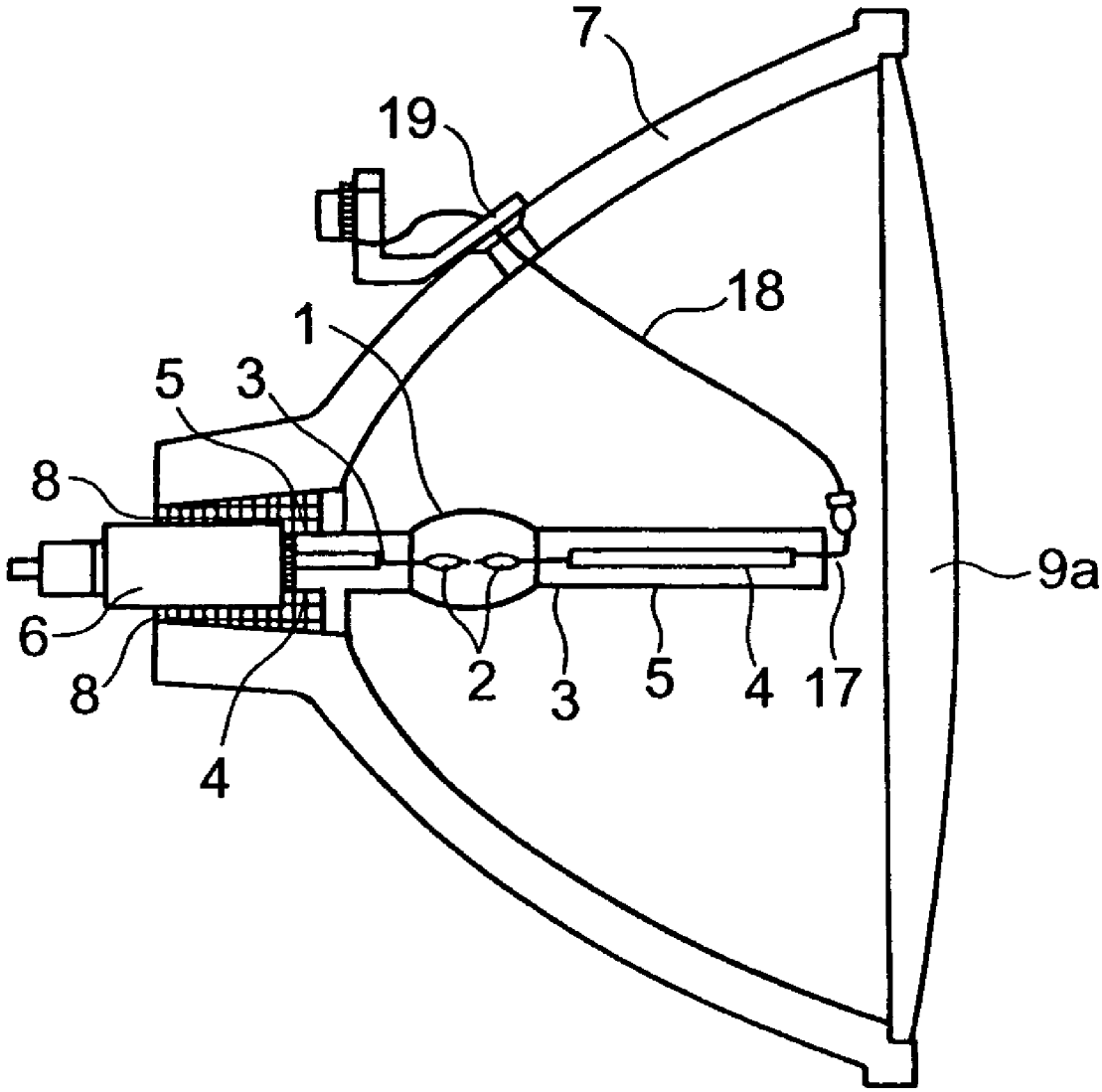
FIG. 11 is a sectional view illustrating a light source for a projector composed of a light source lamp and a reflector according to the present invention.

It is noted that the antireflection film deposited on each of both surfaces of the front glass pane would cause micro-clacks therein due to thermal expansion after it is used for a long time if the internal light absorption rate of the front glass pane exceeds 5%. Thus, a material having a small internal absorption is preferably used. Further, as shown in FIG. 11, if a front glass pane 9*a* has a configuration having a lens function, not only fragments of the glass light bulb due to a burst thereof can be prevented from scattering to the projection optical system, but also the outgoing light beam from the lamp can be controlled with a high degree of accuracy in cooperation of the configuration of the reflection surface. In FIG. 11, like reference numerals are used to denote like parts to those shown in the figures which have been explained hereinabove.

Figure 17:
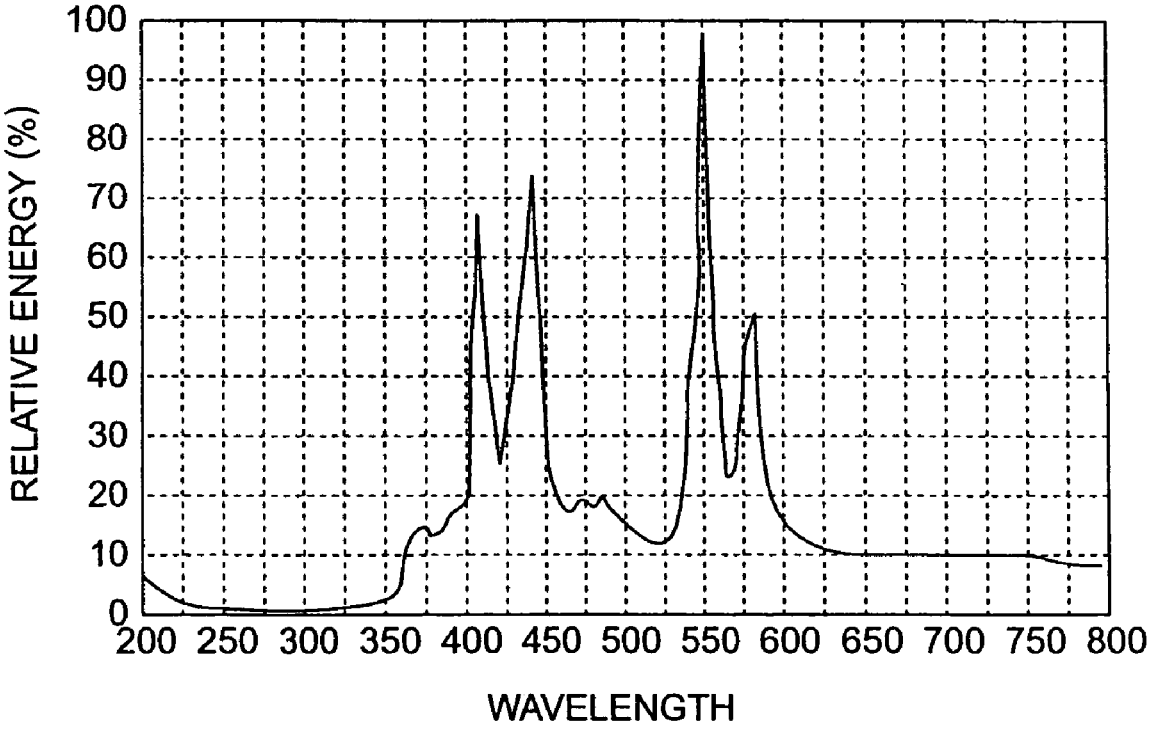
FIG. 17 is a view illustrating a spectral energy distribution of a generally used extra-pressure mercury lamp.

Next, explanation will be made of the characteristic of the reflection film provided on the reflection surface of the reflector in an embodiment of the present invention with reference to FIGS. 17 and 22. FIG. 17 shows a spectrum energy distribution of an extra-high pressure mercury lamp in general, and in FIG. 22, wavelength (nm) is taken along the abscissa while transmissivity with respect to the light beam incident upon the reflection film, perpendicular thereto, is taken along the ordinate.

As found from the spectrum energy distribution shown in FIG. 17, a strong spectrum is present around a blue wavelength that is, 405 nm. Accordingly, the half-value wavelength (transmissivity of 50%) of an UV cut-filter in the reflector is preferably set to a wavelength of not less than 405 nm. If possible, a wavelength around 410 nm is desirable. Further, since the spectrum energy is present (which is not shown) in an infrared zone not less than 800 nm, the characteristic of the reflection film of the reflector is such as allow light in the infrared range to pass therethrough so that it is once absorbed by the reflector while radiation is made outside the reflector.

Figure 22:
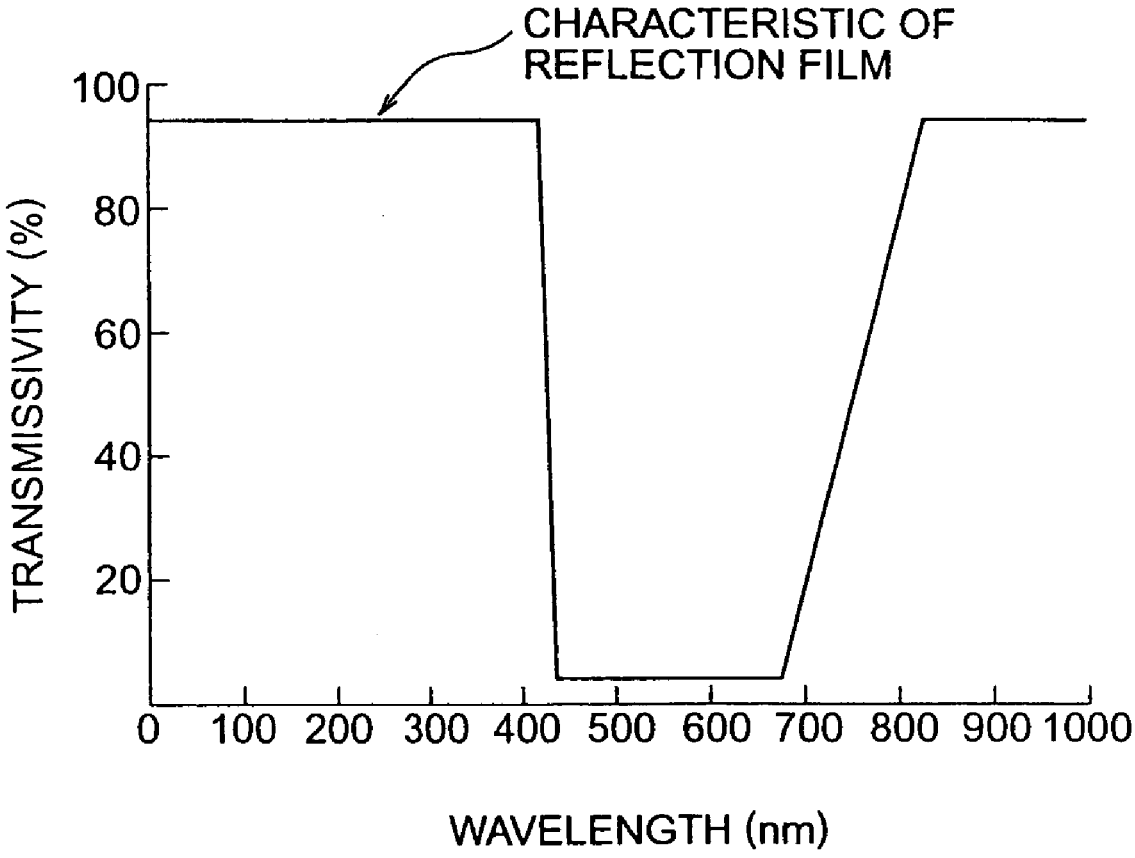
FIG. 22 is a characteristic view illustrating a spectral transmittance of a reflection film formed on a reflector reflection surface.

In view of the foregoing, the reflection film characteristic of the surface of the reflector is set to as shown in FIG. 22. The film is designed so that light rays having a short wavelength of not greater than 410 nm substantially in a blue wavelength range can be transmitted. As a result, ultraviolet rays (having a wavelength of not greater than 380 nm) are directly irradiated onto the thermosetting resin as a base material of the reflector. However, since the ultraviolet absorbent is added in the thermosetting resin in order to absorb the ultraviolet rays, it is possible to prevent detrimental ultraviolet rays from leaking outside from the reflector. Although the transmissivity characteristic of the UV cut-off filter is excellent if its peak is sharper, the shape peak results in increasing of the costs, a number of films is determined as necessary. As the reflection film, an optical multi-layer film made of $TiO_2$ and $SiO_2$ is in general used, and the reflection film having a total number of layers up to a value in the range from 30 to 50 is required. Meanwhile, designing is made so that the characteristic of the reflection film in a long wavelength range is set so as to allow light rays in the near infrared range not less than 800 nm to simultaneously transmit therethrough. As a result, heat flux (from the near infrared rays to the infrared rays) is absorbed by the reflector, it is possible to restrain the other components included in the projector, from increasing their temperature, thereby it is possible to enhance the use life. In this arrangement, if the color of the thermosetting resin from which the reflector is formed is black, it goes without saying that the light absorption can be made with a higher degree of efficiency. A temperature rise caused by the absorbed heat flux, can be lowered by the heat radiation fins since the heat is effectively radiated by the heat radiation fins, as mentioned above.

In the visual light range, if the vertical transmissivity of light rays having wavelengths in a range from 420 to 700 nm can be set to a value which is not greater than 15%, a highly efficient reflector can be obtained. Further, if the vertical transmissivity of light rays having wavelengths in a range from 420 to 680 nm can be set to a value which is less than 4%, divergent light beams from a light bulb can be effectively trapped, in comparison with an Al deposited film (having a reflectance of about 90%, so that a spectrum reflectance is substantially flat).

As mentioned above, explanation has been made of the optical multi-layer film which allows ultraviolet rays and infrared rays other than the visible light rays to pass therethrough, as a reflection film applied on the reflection surface of the reflector. Next, explanation will be hereinbelow made of a metal reflection thin film. That is, a reflector is split at least into a reflector on the bottom side and a reflector on the opening side, as shown in FIG. 4, the reflector on the bottom side being made of heat-resistant glass while the reflector on the opening side is made of a heat-resistant organic material as a base material. In the above-mentioned case, the above-mentioned multilayer film is used as a reflection film used in the reflector on the bottom side made of heat-resistant glass, and a metal thin film made of alumina, silver, silver alloy or the like, is used as a reflection film in the reflector made of the heat-resistant organic material on the opening side. In particular, the metal reflection film containing silver exhibits a reflectance of not less than about 98% with respect a wavelength in a range from 450 to 650 nm, and offers such an advantage that the reflectance with respect to 650 nm is higher than that with respect to a wavelength of 450 nm. In this case, the reflector on the opening side, made of the heat-resistant organic material is colored with a color having a radiation rate of not greater than 0.5. For example, the color is white. With this configuration, if the base material of the reflection surface is visible due to any reason, the heat flux from the lamp can be reflected without being absorbed.

Although the specific embodiments using the extra-high pressure mercury lamp, according to the present invention have been explained, but it goes without saying that the present invention can offer similar advantages even though a xenon lamp which is excellent in luster is used.

Figure 19:
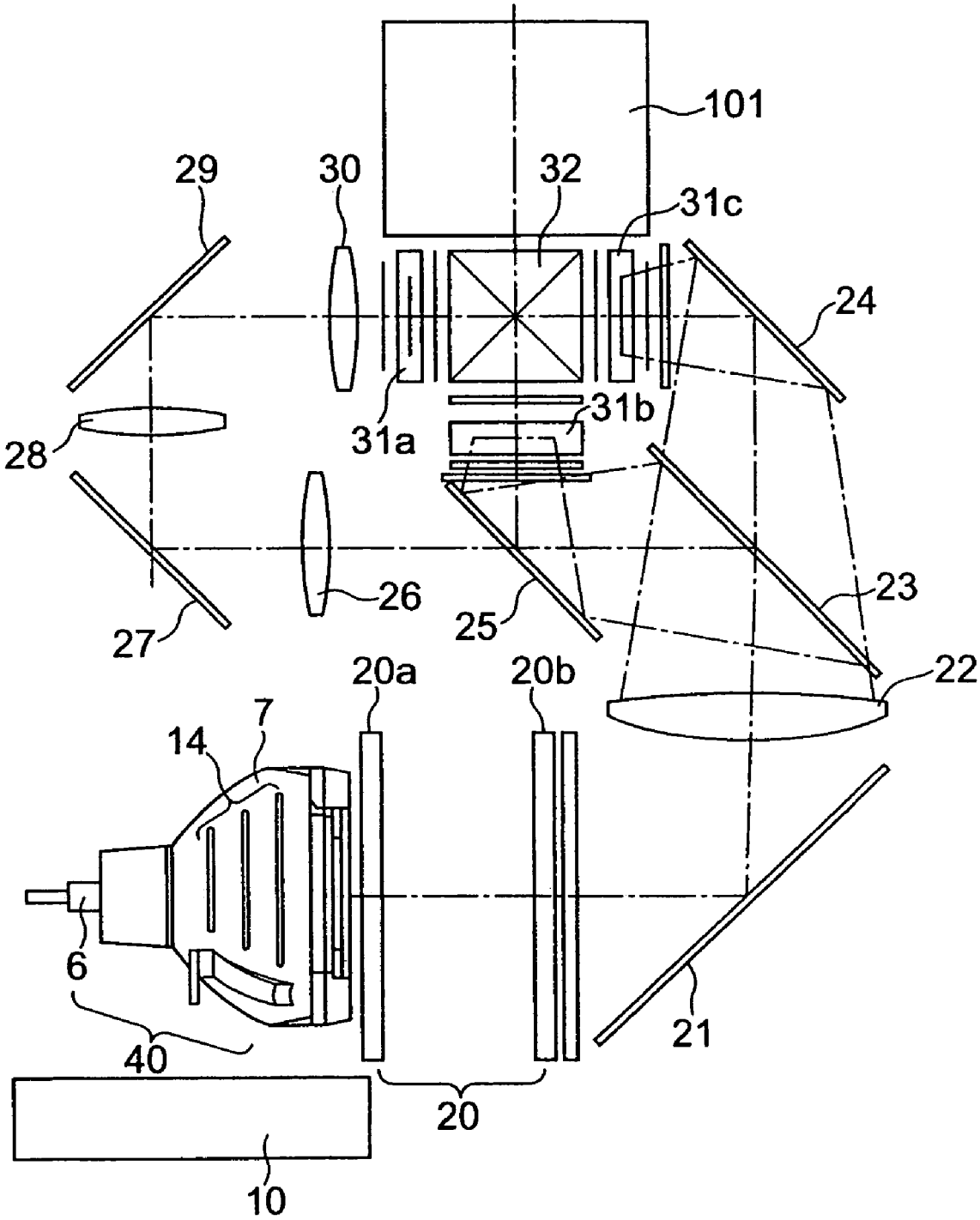
FIG. 19 is a view illustrating a layout of an illumination optical system for a liquid crystal projector using the light source for a projector according to the present invention.

Referring to FIG. 19 which is a view illustrating a layout of a projection optical system in a liquid crystal projector using a light source for a projector according to the present invention, there is shown a well-known integrator optical system (which will be referred to as a muti-lens array) 20 composed of a first multi-lens array 20*a* in which an incident light beam is split into a plurality of light beams by a plurality of rectangular lens elements which are arranged in a matrix-like array, and a second multi-lens array 20*b* in which the plurality of light beams split by the first multi-lens array are magnified and projected onto liquid crystal panels in superposition by a plurality of rectangular lens elements arranged in a matrix-like array, and which incorporates such a polarization changing function that desired polarized waves are emitted by a plurality of polarized beam splitters and a plurality of ½ λ phase plates provided corresponding to the plurality of lens elements. Further, the light source 40 for a projector and the multi-lens array 20 in combination constitute a polarization projector for projecting desired polarized wave components. There are shown the liquid crystal panels 31*a*, 31*b*, 31*c* for a red color, a green color and a blue color, respectively, dichroic mirrors 23, 25 for spectroscopically separating a white beam from the light source for a projector into three primary color beams, field lenses 30, 28, 26 for defining sizes of light beams, a condenser lens 22 for converging a light beam incident upon the multi-lens array into a converged light beam, the light source 40 for a projector, according to the present invention, provided with heat radiation fins 14 laid in a direction orthogonal to the optical axis of a lamp, a cooling fan 10 arranged at one side surface of the light source for a projector, for controlling the temperature of the light source for a projector to a desired temperature, reflection mirrors 21, 24, 27, 29 and a light synthesizing prism 32 for synthesizing image light beams which are obtained by modulating the three primary color light beams through the respective liquid crystal panels.

Explanation will be hereinbelow made of operation of the liquid crystal projector shown in FIG. 19. The white light beam from the light source 40 for a projector is turned by the multi-lens array into a light beam having a desired polarized component, and then the light beams is then emitted and reflected by the reflection mirror 21. The light beam is finally incident upon the condenser lens 22 which causes the light beams into which the multi-lens array 20 splits the white light beam, to be incident upon the liquid crystal panels 31*a*, 31*b*, 31*c*, respectively. The color light beam which is incident upon the liquid crystal panel 31 by way of the reflection mirrors 27, 29 is corrected by the field lenses 26, 28, 30 since the optical path length of this color light beam becomes longer than that of the other color light beams. The color light beams incident upon the liquid crystal panels 31*a*, 31*b*, 31*c* transmit through the panels while they are optically modulated in response to image signals (which is not shown). The color light beams are then chromatically synthesized by the light synthesizing prism 32, and are then magnified and projected on a screen (which is not shown) by the projection lens 101.

Figure 20:
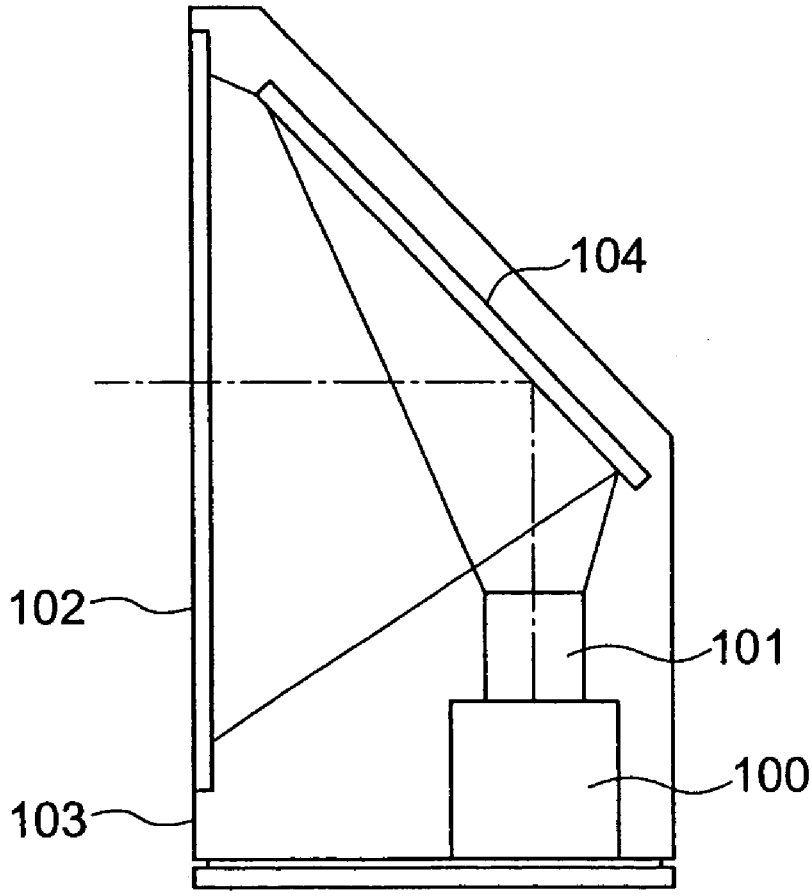
FIG. 20 is a vertical sectional view illustrating a principal part of a rear projection type image display apparatus installed therein with an projection optical system according to the present invention.
Figure 21:
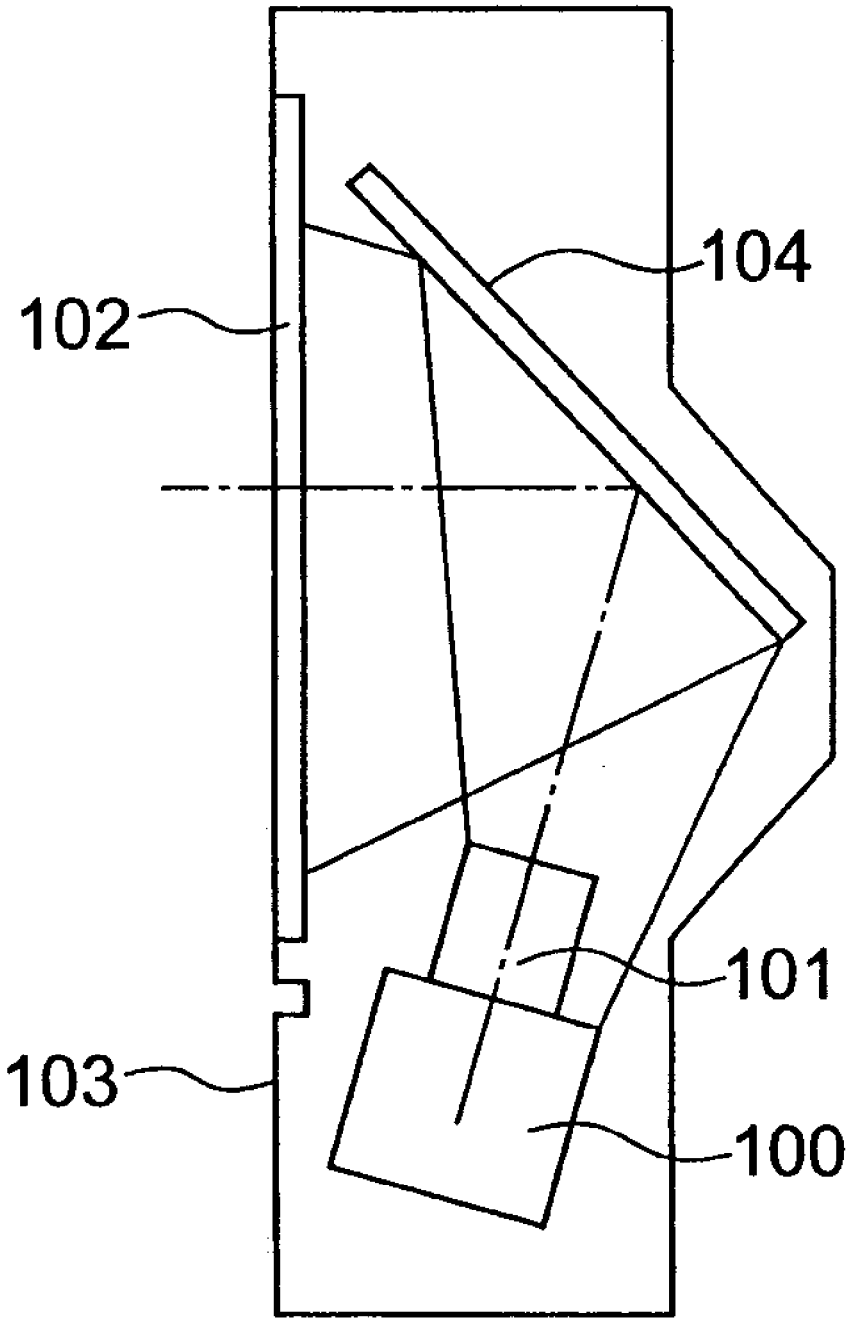
FIG. 21 is a vertical sectional view illustrating a principal part of a rear projection type image display apparatus installed therein with an projection optical system according to the present invention.

Next, referring to FIGS. 20 and 21 which are vertical sectional views illustrating an essential part of a rear projection type image display apparatus incorporating the light source for a projector according to the present invention, an image obtained by an optical unit 100 is magnified and projected onto a screen 102 by the projection lens 101 by way of a fold-back mirror 104. FIG. 20 shows the configuration of a cabinet 103 in such a case that the set height is reduced, and FIG. 21 shows the configuration of the cabinet 103 in such a case that the set depth is reduced.

As mentioned above, according to the present invention, there can be provided a light source for a projector, incorporating a reflector which is highly accurate, and which is excellent in moldability and workability, and which is also excellent in the reflectivity, and a projector incorporating the light source.

It should be further understood by those skilled in the art that although the foregoing description has been made on embodiments of the invention, the invention is not limited thereto and various changes and modifications may be made without departing from the spirit of the invention and the scope of the appended claims.

What is claimed is:

1. A projector light source for emitting a light beam to a display element, comprising an arc tube for emitting a light beam and a concave reflector having a concave reflection surface, for reflecting the light beam from the arc tube so that the light beam outgoes through an opening of the concave reflector, wherein said concave reflector is split into at least two separate portions at a plane substantially parallel with an optical axis of the concave reflector, and said two separate portions are fastened together by fastening means.

2. A projector light source as set forth in claim 1, wherein the opening of the concave reflector is formed with a groove in its inner peripheral part, and the concave reflector is provided with a front glass pane in the opening thereof, the front glass being fitted at its outer peripheral part in the groove and being held between the two separate portions.

3. A projector light source as set forth in claim 1, wherein said reflection surface of the concave reflector have a configuration exhibited by the following formula:

$$z(r) = (1/RD)r^2 \Big/ \left[1 + \sqrt{1-(1-CC)r^2(1/RD)^2}\right] + AE*r^4 + AF*r^6 + AG*r^8 + AH*r^{10} + \ldots + AR*r^n$$

where z(r) is a height of the reflection surface in such a condition that an arc axial direction of the light emitting tube containing a focal point of the reflection surface is taken on a Z-axis while a radial direction of the reflector orthogonal to the Z-axis is taken on an r-axis, r is a distance in the radial direction, RD, CC, AB, AF, AG, AH, . . . AR are arbitrary constants, and n is an arbitrary nonnegative integer.

4. A projector light source as set forth in claim 1, wherein the arc tube has an optical center which is located substantially at the focal point of the reflection surface, and the arc axis of the arc tube is substantially aligned on the optical axis of the concave reflector, the reflector being made of a heat-resistant organic material mingled therein with a high thermal conductive substance, and the reflector having a bottom part with an average wail thickness that is larger than that of a beam outgoing part of the reflector.

5. A projector light source as set forth in claim 1, wherein said arc tube is a short-arc type discharge lamp in which at least xenon or mercury is charged, a pair of electrodes provided at opposite ends of the arc tube have a distance of not greater than 1.8 mm therebetween, and which is turned on with a rated power of not greater than 250 W, and the concave reflector has a focal distance of not greater than 4 mm.

6. A projector light source of claim 1, wherein said reflector is formed on said concave reflection surface with a reflection film having a vertical transmissivity of not less than 50% for a light beam having a wavelength of not greater than 410 nm, but not greater than 15% for a light beam having a wave length from 420 to 700 nm, and not less than 50% for a light beam having a wavelength of not less than 800 nm.

7. A projector light source for emitting a light beam to a display element, comprising an arc tube for emitting a light beam and a concave reflector having a concave reflection surface, for reflecting the light beam from the arc tube so that the light beam outgoes through an opening of the concave reflector, wherein said concave reflector has a structure which can be split into at least two portions at a plane substantially parallel with an optical axis of the concave reflector, and wherein the arc tube has an optical center which is located substantially at the focal point of the reflection surface, and the arc axis of the arc tube is substantially aligned on the optical axis of the concave reflector, the reflector being made of a heat-resistant organic material mingled therein with a high thermal conductive substance, and the reflector having a bottom part with an average wall thickness that is larger than that of a beam outgoing part of the reflector.

8. A projector light source as set forth in claim 7, wherein the concave reflector is provided with a front glass pane in the opening thereof.

9. A projector light source as set forth in claim 7, wherein said reflection surface of the concave reflector has a configuration exhibited by the following formula:

$$z(r) = (1/RD)r^2 \Big/ \left[1 + \sqrt{1-(1-CC)r^2(1/RD)^2}\right] + AE*r^4 + AF*r^6 + AG*r^8 + AH*r^{10} + \ldots + AR*r^n$$

where z(r) is a height of the reflection surface in such a condition that an arc axial direction of the light emitting tube containing a focal point of the reflection surface is taken on a Z-axis while a radial direction of the reflector orthogonal to the Z-axis is taken on an r-axis, r is a distance in the radial direction, RD, CC, AE, AF, AG, AH, . . . AR are arbitrary constants, and n is an arbitrary nonnegative integer.

10. A projector light source as set forth in claim 7, wherein said arc tube is a short-arc type discharge lamp in which at least xenon or mercury is charged, a pair of electrodes provided at opposite ends of the arc tube have a distance of not greater than 1.8 mm therebetween, and which is turned on with a rated power of not greater than 250 W, and the concave reflector has a focal distance of not greater than 4 mm.

11. A projector light source for emitting a light beam to a display element, comprising an arc tube for emitting a light beam and a concave reflector having a concave reflection surface, for reflecting the light beam from the arc tube so that the light beam outgoes through an opening of the concave reflector, wherein said concave reflector has a structure which can be split into at least two portions at a plane substantially parallel with an optical axis of the concave reflector, wherein said concave reflector is formed on said concave reflection surface with a reflection film having a vertical transmissivity of not less than 50% for a light beam having a wavelength of not greater than 410 nm, but not greater than 15% for a light beam having a wave length from 420 to 700 nin, and not less than 50% for a light beam having a wavelength of not less than 800 nm.

12. A projector light source as set forth in claim 11, wherein the concave reflector is provided with a front glass pane in the opening thereof.

13. A projector light source as set forth in claim 11, wherein said reflection surface of the concave reflector has a configuration exhibited by the following formula:

$$z(r) = (1/RD)r^2 \Big/ \left[1 + \sqrt{1 - (1 - CC)r^2(1/RD)^2}\right] + AE*r^4 + AF*r^6 + AG*r^8 + AH*r^{10} + \ldots + AR*r^n$$

where z(r) is a height of the reflection surface in such a condition that an arc axial direction of the light emitting tube containing a focal point of the reflection surface is taken on a Z-axis while a radial direction of the reflector orthogonal to the Z-axis is taken on an r-axis, r is a distance in the radial direction, RD, CC, AE, AF, AG, AH, . . . AR are arbitrary constants, and n is an arbitrary nonnegative integer.

14. A projector light source as set forth iii claim 11, wherein the arc tube has an optical center which is located substantially at the focal point of the reflection surface, and the arc axis of the arc tube is substantially aligned on the optical axis of the concave reflector, the reflector being made of a heat-resistant organic material mingled therein with a high thermal conductive substance, and the reflector having a bottom part with an average wall thickness that is larger than that of a beam outgoing part of the reflector.

15. A projector light source as set forth in claim 11, wherein said arc tube is a short-arc type discharge lamp in which at least xenon or mercury is charged, a pair of electrodes provided at opposite ends of the arc tube have a distance of not greater than 1.8 mm therebetween, and which is turned on with a rated power of not greater than 250 W, and the concave reflector has a focal distance of not greater than 4 mm.

* * * * *